US010920418B2

(12) United States Patent
Gosling et al.

(10) Patent No.: US 10,920,418 B2
(45) Date of Patent: Feb. 16, 2021

(54) MODULAR WALLS INCORPORATING RECESSED, EXTENDABLE FURNITURE

(71) Applicant: DIRTT Environmental Solutions, Ltd, Calgary (CA)

(72) Inventors: Geoff Gosling, Calgary (CA); Mogens F. Smed, DeWinton (CA); Colin V. Blehm, Calgary (CA); Gregory G. C. Olsen, Calgary (CA)

(73) Assignee: DIRTT ENVIRONMENTAL SOLUTIONS, LTD, Calgary (CA)

( * ) Notice: Subject to any disclaimer, the term of this patent is extended or adjusted under 35 U.S.C. 154(b) by 642 days.

(21) Appl. No.: 14/683,684

(22) Filed: Apr. 10, 2015

(65) Prior Publication Data

US 2015/0211228 A1 Jul. 30, 2015

Related U.S. Application Data

(63) Continuation of application No. 29/493,280, filed on Jun. 6, 2014, now Pat. No. Des. 754,991, and a (Continued)

(51) Int. Cl.
*E04B 2/74* (2006.01)
*A47B 5/04* (2006.01)

(Continued)

(52) U.S. Cl.
CPC ..... *E04B 2/7407* (2013.01); *A47B 3/00* (2013.01); *A47B 5/00* (2013.01); *A47B 5/04* (2013.01);

(Continued)

(58) Field of Classification Search
CPC ..... A47C 17/38; A47C 17/48; A47C 17/52; A61G 7/00; A47B 87/007
See application file for complete search history.

(56) References Cited

U.S. PATENT DOCUMENTS 2,042,290 A 5/1936 Barrett
2,658,810 A 11/1953 Ellis (Continued)

FOREIGN PATENT DOCUMENTS

CA 55086 10/1985
CA 1294107 11/1987

(Continued)

OTHER PUBLICATIONS

Decision Granting Institution (IPR2015-01691), *Allsteel* v. *DIRTT Environmental Solutions* dated Feb. 2, 2016.

(Continued)

*Primary Examiner* — Peter M. Cuomo
*Assistant Examiner* — Ifeolu A Adeboyejo
(74) *Attorney, Agent, or Firm* — Workman Nydegger; Michael J. Frodsham

(57) ABSTRACT

A modular wall includes a plurality of inter-connectable and interchangeable wall modules. At least one of the wall modules includes a recessed, extendable piece of furniture, such as a bed, desk, table, work surface or chair. When in a closed configuration, the furniture folds into or otherwise resides within a recessed pocket in the modular wall. When in the closed configuration, the outer surface of the furniture forms an exterior surface of the wall module; thereby, concealing the furniture seamlessly into the modular wall. The exterior surface can comprise one or more exterior interchangeable tiles.

20 Claims, 12 Drawing Sheets

Related U.S. Application Data continuation of application No. 13/582,978, filed on Sep. 5, 2012, now Pat. No. 9,084,489, said application No. 29/493,280 is a continuation of application No. 13/582,978, filed as application No. PCT/US2012/042314 on Jun. 13, 2012, now Pat. No. 9,084,489.

(60) Provisional application No. 61/581,002, filed on Dec. 28, 2011.

(51) Int. Cl.

| | |
|---|---|
| ***A47C 17/38*** | (2006.01) |
| ***A47C 17/40*** | (2006.01) |
| ***A47C 19/20*** | (2006.01) |
| ***A47B 5/06*** | (2006.01) |
| ***A47B 3/00*** | (2006.01) |
| ***A47C 9/06*** | (2006.01) |
| ***A47B 5/00*** | (2006.01) |

(52) U.S. Cl.

CPC ..... *A47B 5/06* (2013.01); *A47C 9/06* (2013.01); *A47C 17/38* (2013.01); *A47C 17/40* (2013.01); *A47C 19/20* (2013.01); *E04B 2002/7483* (2013.01)

(56) References Cited

U.S. PATENT DOCUMENTS 2,676,481 A 4/1954 Hoffman
3,037,593 A 6/1962 Webster
3,088,127 A 5/1963 Charles
3,180,457 A 4/1965 Bohnsack
3,521,937 A 7/1970 Buhrmaster
3,602,226 A 9/1971 Ericson
3,621,635 A 11/1971 Lange
3,675,382 A 7/1972 Lickliter
3,696,569 A 10/1972 Didry
3,885,361 A 5/1975 De Schutter
4,027,878 A 6/1977 Dadbeh
4,103,373 A 8/1978 Luedtke
4,128,983 A 12/1978 Matsubara
4,277,920 A 7/1981 Dixon
4,438,614 A 3/1984 Raith
4,449,337 A 5/1984 Gzym
4,493,172 A 1/1985 Jones
4,535,577 A 8/1985 Tenser
4,631,881 A 12/1986 Charman
4,688,491 A 8/1987 Herrera
4,752,101 A 6/1988 Yurchenco
4,757,657 A 7/1988 Mitchell
D302,497 S 8/1989 Zapf
D309,381 S 7/1990 Buhk
D309,382 S 7/1990 Randall
D309,384 S 7/1990 Buhk
D309,385 S 7/1990 Buhk
D309,386 S 7/1990 Buhk
4,991,365 A 2/1991 Jackson
5,038,539 A * 8/1991 Kelley ..... A47B 21/06 211/190
5,056,285 A 10/1991 Frascaroli
D321,801 S 11/1991 Friedman
5,064,247 A 11/1991 Clark
D323,251 S 1/1992 Zapf
5,086,597 A 2/1992 Kelley
D325,309 S 4/1992 Worrell
5,117,599 A 6/1992 Voss
D327,794 S 7/1992 Zapf
D328,680 S 8/1992 Zapf
5,144,777 A 9/1992 Fishel
D330,295 S 10/1992 Zapf
5,155,955 A 10/1992 Ball
D330,641 S 11/1992 Zapf
D330,643 S 11/1992 Zapf
5,159,793 A 11/1992 Deugo
D331,335 S 12/1992 Zapf
D331,513 S 12/1992 Zapf
5,171,060 A 12/1992 Kaye
5,172,530 A 12/1992 Fishel
5,184,441 A 2/1993 Balfanz
5,204,149 A 4/1993 Phenicie
5,207,037 A 5/1993 Giles
5,218,799 A 6/1993 Appino
D337,003 S 7/1993 Rowland
5,227,005 A 7/1993 Zodrow et al.
5,277,005 A * 1/1994 Hellwig ..... E04B 2/7422 174/495
5,321,579 A 6/1994 Brown
D348,786 S 7/1994 Tolleson
5,351,452 A 10/1994 Gates
5,352,033 A 10/1994 Gresham
5,394,668 A 3/1995 Lim
5,488,808 A 2/1996 Cahill
D371,683 S 7/1996 Tolleson
5,544,593 A 8/1996 Canfield
5,592,794 A 1/1997 Tundaun
5,600,926 A 2/1997 Ehrlich
5,601,348 A 2/1997 Minkovski
5,642,593 A 7/1997 Sheih
5,669,314 A 9/1997 Grant
5,740,644 A 4/1998 Menchetti
5,740,650 A 4/1998 Seiber
5,740,744 A * 4/1998 Nashirozawa ..... G07F 19/20 109/24.1
5,746,035 A 5/1998 Seiber
5,778,612 A 7/1998 Kissinger et al.
5,792,541 A 8/1998 Herrera
D397,880 S 9/1998 Saul
D398,464 S 9/1998 Cronk
5,802,789 A 9/1998 Goodman
5,813,178 A 9/1998 Edwards
5,822,935 A 10/1998 Mitchell
5,826,385 A 10/1998 Dykstra
5,836,121 A 11/1998 Hofman
5,839,240 A 11/1998 Eisholz
5,852,904 A 12/1998 Yu
5,870,867 A 2/1999 Mitchell
5,875,596 A 3/1999 Muller
5,881,979 A 3/1999 Rozier
5,913,787 A 6/1999 Edwards
5,931,429 A 8/1999 Hellwig et al.
5,950,386 A 9/1999 Shipman
5,978,988 A 11/1999 Burchell
6,012,258 A 1/2000 Brown
6,047,508 A 4/2000 Goodman
6,058,667 A 5/2000 MacDonald
6,094,872 A 8/2000 Ward
6,112,472 A 9/2000 Van Dyk
6,122,871 A 9/2000 Russell
6,128,877 A 10/2000 Goodman
6,134,845 A 10/2000 Shipman
6,141,926 A 11/2000 Rossiter
6,158,179 A 12/2000 Ackerly
6,161,347 A 12/2000 Yu
6,189,270 B1 2/2001 Jeffers
6,223,485 B1 5/2001 Beck
6,250,020 B1 6/2001 Shipman
6,250,032 B1 6/2001 Davis
6,260,321 B1 7/2001 Rudduck
6,282,854 B1 9/2001 Vos
6,295,764 B1 10/2001 Berrdige
6,301,846 B1 10/2001 Waalkes
6,311,441 B1 11/2001 Beavers
6,330,773 B1 12/2001 MacDonald
6,341,457 B1 1/2002 Aerts
6,363,663 B1 4/2002 Kane
6,393,782 B1 5/2002 Berrdige
6,393,783 B2 5/2002 Emaus
6,397,533 B1 6/2002 Hornberger
6,415,567 B1 7/2002 Mead
6,446,396 B1 9/2002 Marangoni
6,481,168 B1 11/2002 Hodges
6,484,465 B2 11/2002 Higgins

(56) References Cited

U.S. PATENT DOCUMENTS 6,490,154 B2 * 12/2002 Thompson ..... G06F 1/1632 361/679.09
6,497,075 B1 * 12/2002 Schreiner ..... A47B 21/06 52/127.6
6,530,181 B1 3/2003 Seiber
6,557,310 B2 5/2003 Marshall
6,571,855 B1 6/2003 Goldsmith
6,581,344 B1 6/2003 Niewiadomski
6,591,563 B2 7/2003 King
6,612,077 B2 9/2003 Parshad
6,619,008 B1 9/2003 Shivak
6,658,805 B1 12/2003 Yu
6,668,514 B2 12/2003 Skov
D485,096 S 1/2004 Overthun
6,684,929 B2 2/2004 MacDonald
6,688,056 B2 2/2004 Von Hoyningen Huene
6,701,677 B2 3/2004 Gresham
6,711,871 B2 3/2004 Beirise
6,729,085 B2 5/2004 Newhouse
6,748,710 B2 6/2004 Gresham
6,775,953 B2 8/2004 Burken
6,799,404 B2 10/2004 Spransy
6,807,776 B2 10/2004 Girdwood
6,820,388 B2 11/2004 Newhouse
6,851,226 B2 2/2005 MacGregor
6,865,853 B2 3/2005 Burken
6,883,277 B2 4/2005 Wiechecki
6,889,477 B1 5/2005 Kottman
6,920,727 B2 7/2005 Yu
6,928,785 B2 8/2005 Shipman
6,941,716 B2 9/2005 Kottman
6,944,993 B1 9/2005 Jilk
6,951,085 B2 10/2005 Hodges
6,964,138 B2 11/2005 Carroll
6,981,454 B2 1/2006 Burdick
6,990,909 B2 1/2006 Gosling
6,993,875 B2 2/2006 Rudduck
7,051,482 B2 5/2006 MacDonald
7,150,127 B2 * 12/2006 Underwood ..... A47B 46/005 52/36.1
7,210,270 B1 5/2007 King
7,310,918 B1 12/2007 Reuter
7,434,790 B1 10/2008 Hansen
7,451,577 B2 11/2008 Little
7,461,484 B2 12/2008 Battey
7,540,115 B2 6/2009 Metcalf
7,562,504 B2 7/2009 Herbst
7,603,821 B2 10/2009 Eberlein
7,644,552 B2 1/2010 Kuipers
7,661,237 B2 2/2010 Jakob-Bamberg
7,707,790 B2 5/2010 Williams
7,818,932 B2 10/2010 Eberlein
7,827,745 B2 11/2010 Franceschet
7,832,154 B2 11/2010 Gosling
7,841,142 B2 11/2010 Towersey
7,856,777 B2 12/2010 Lamfers
7,861,474 B2 1/2011 Houle
7,891,148 B2 2/2011 Underwood
7,908,805 B2 3/2011 Metcalf
7,913,459 B2 3/2011 Ball
7,918,064 B2 4/2011 Singleton
7,922,224 B2 4/2011 Arias
7,984,598 B2 7/2011 Gosling
8,015,766 B2 9/2011 Gosling
8,015,767 B2 9/2011 Glick
8,024,901 B2 * 9/2011 Gosling ..... E04B 2/7424 52/238.1
8,033,059 B2 10/2011 Contois
8,033,068 B2 10/2011 Luttmann
8,046,957 B2 11/2011 Towersey
8,151,527 B2 4/2012 Gosling
8,151,533 B2 4/2012 Krieger
8,176,707 B2 5/2012 Gosling
8,215,061 B2 7/2012 Gosling
8,272,180 B2 9/2012 Glick
8,307,591 B2 11/2012 Steinle
8,322,102 B2 12/2012 Krieger
8,393,122 B2 3/2013 Henriott
8,441,782 B2 * 5/2013 Thomas ..... A47B 43/00 361/679.02
8,474,193 B2 7/2013 Sutton
8,479,026 B2 7/2013 Lakshmanan
8,534,021 B2 9/2013 Liu
8,601,749 B2 12/2013 Von Hoyningen Huene
8,613,168 B2 12/2013 Von Hoyningen Huene
8,615,936 B2 12/2013 Von Hoyningen Huene
8,656,648 B2 2/2014 Liegeois
8,683,745 B2 4/2014 Artwohl
D710,025 S 7/2014 Johnson
8,910,435 B2 12/2014 Feldpausch
D725,638 S 3/2015 Hofman
8,966,839 B2 3/2015 Rebman
9,003,731 B2 4/2015 Gosling
D731,833 S 6/2015 Fifield
9,084,489 B2 7/2015 Gosling
9,206,600 B2 12/2015 Von Hoyningen Huene
9,284,729 B2 3/2016 Von Hoyningen Huene
2001/0039774 A1 11/2001 Beirise
2002/0053174 A1 5/2002 Barmark
2002/0104271 A1 * 8/2002 Gallant ..... A61G 7/00 52/36.1
2002/0108330 A1 8/2002 Yu
2002/0121056 A1 9/2002 Von Hoyningen
2002/0124514 A1 9/2002 Higgins
2002/0129574 A1 9/2002 Newhouse
2002/0144476 A1 10/2002 Mastelli
2002/0157335 A1 10/2002 Vos
2003/0005514 A1 1/2003 Kunkel
2003/0060080 A1 3/2003 Rees
2003/0089057 A1 5/2003 Wiechecki
2003/0154673 A1 * 8/2003 MacGregor ..... A47B 83/001 52/239
2003/0196388 A1 * 10/2003 Edwards ..... A47B 96/00 52/36.1
2003/0221384 A1 12/2003 Burken
2004/0010998 A1 1/2004 Turco
2004/0020137 A1 2/2004 Battey
2004/0035074 A1 2/2004 Stanescu
2004/0093805 A1 5/2004 Underwood
2004/0177573 A1 9/2004 Newhouse
2005/0005527 A1 1/2005 Metcalf
2005/0086871 A1 4/2005 MacGregor
2006/0042141 A1 3/2006 Hansen
2006/0048457 A1 3/2006 Yang
2006/0059806 A1 3/2006 Gosling
2006/0185276 A1 * 8/2006 Pai ..... G06F 1/1601 52/238.1
2007/0277449 A1 12/2007 Burns
2007/0289225 A1 * 12/2007 Kern ..... A47B 87/007 52/36.1
2008/0069632 A1 3/2008 Gosling
2008/0168930 A1 * 7/2008 Calero ..... A47B 21/0314 108/50.02
2008/0295426 A1 12/2008 Milligan
2008/0302054 A1 12/2008 Gosling
2009/0021122 A1 1/2009 Green
2009/0241437 A1 10/2009 Steinle
2009/0260311 A1 10/2009 Boyer
2009/0293406 A1 12/2009 Gosling
2010/0043142 A1 2/2010 Whitford
2010/0192511 A1 8/2010 Gosling
2010/0223857 A1 9/2010 Sutton
2010/0307086 A1 12/2010 Hibbs
2011/0113692 A1 5/2011 Stamper
2011/0197519 A1 8/2011 Henriott
2012/0186164 A1 7/2012 Pensi
2012/0317899 A1 12/2012 Von Hoyningen Huene
2014/0102021 A1 4/2014 Gosling
2014/0202361 A1 7/2014 Siwiec
2014/0310873 A1 10/2014 Gosling
2014/0338120 A1 11/2014 Baugh
2015/0007516 A1 1/2015 Glick
2015/0211228 A1 7/2015 Smed et al.

(56) References Cited

U.S. PATENT DOCUMENTS

| | | | |
|---|---|---|---|
| 2015/0354212 | A1 | 12/2015 | Von Hoyningen Huene |
| 2016/0032644 | A1 | 2/2016 | Geller |
| 2016/0053485 | A1 | 2/2016 | Von Hoyningen Huene |

FOREIGN PATENT DOCUMENTS

| | | |
|---|---|---|
| CA | 2011977 | 10/1990 |
| CA | 2002674 | 5/1991 |
| CA | 2040822 | 11/1991 |
| CA | 2162300 | 5/1997 |
| CA | 2273631 | 10/2001 |
| CA | 2324050 | 4/2002 |
| CA | 2348060 | 11/2002 |
| CA | 2359165 | 4/2003 |
| CA | 2310869 | 8/2003 |
| CA | 2476368 | 1/2006 |
| CA | 2428593 | 8/2007 |
| CA | 2359547 | 2/2008 |
| CA | 2591176 | 12/2008 |
| CA | 2634407 | 12/2008 |
| CA | 2349964 | 10/2009 |
| CA | 2840843 | 12/2013 |
| CA | 2535213 | 4/2014 |
| CA | 2863783 | 4/2014 |
| CH | 686795 | 6/1996 |
| CN | 202069245 | 12/2011 |
| DE | 1659015 | 11/1971 |
| DE | 4207753 | 9/1993 |
| DE | 69316247 | 7/1998 |
| DE | 19960535 | 6/2001 |
| DE | 202004017808 | 1/2005 |
| EP | 0302564 | 2/1989 |
| EP | 0443202 | 8/1991 |
| EP | 0557092 | 1/1998 |
| EP | 0963719 | 12/1999 |
| EP | 1094167 | 4/2001 |
| EP | 2736382 | 6/2014 |
| FR | 1526637 | 5/1968 |
| GB | 1259347 | 1/1972 |
| GB | 1400613 | 7/1975 |
| GB | 2221946 | 2/1990 |
| GB | 2283071 | 4/1995 |
| GB | 2353541 | 10/2003 |
| JP | HO3 17333 | 1/1991 |
| JP | 2003105908 | 4/2003 |
| JP | 2005155223 | 6/2005 |
| KR | 20000049102 | 7/2000 |
| KR | 1020070077502 | 7/2007 |
| WO | WO9212074 | 7/1992 |
| WO | WO9212300 | 7/1992 |
| WO | WO9315970 | 8/1993 |
| WO | WO9323629 | 11/1993 |
| WO | WO9402695 | 2/1994 |
| WO | WO9633323 | 10/1996 |
| WO | WO9746770 | 12/1997 |
| WO | WO9807357 | 2/1998 |
| WO | WO9816699 | 4/1998 |
| WO | WO9829623 | 7/1998 |
| WO | WO9837292 | 8/1998 |
| WO | WO9851876 | 11/1998 |
| WO | WO9946453 | 9/1999 |
| WO | WO9946455 | 9/1999 |
| WO | WO9946458 | 9/1999 |
| WO | WO9953156 | 10/1999 |
| WO | WO9958780 | 11/1999 |
| WO | WO9963177 | 12/1999 |
| WO | WO0015918 | 3/2000 |
| WO | 00/52111 A1 | 9/2000 |
| WO | WO0075447 | 12/2000 |
| WO | WO0171241 | 9/2001 |
| WO | WO0208851 | 1/2002 |
| WO | WO02052111 | 4/2002 |
| WO | WO02103129 | 12/2002 |
| WO | WO03071045 | 8/2003 |
| WO | WO2003071045 | 8/2003 |
| WO | WO03104581 | 12/2003 |
| WO | WO2003104581 | 12/2003 |
| WO | 2005120294 | 12/2005 |
| WO | 2006127804 | 11/2006 |
| WO | 2010121788 | 10/2010 |
| WO | WO2012173930 | 12/2012 |
| WO | WO2013101298 | 7/2013 |
| WO | WO2013130871 | 9/2013 |
| WO | WO2013185141 | 12/2013 |
| WO | WO2013188211 | 12/2013 |
| WO | WO2013188235 | 12/2013 |
| WO | 2014039278 | 3/2014 |
| WO | WO2014055883 | 4/2014 |

OTHER PUBLICATIONS

Canadian Office Action for Application No. 2,800,414 dated Jul. 15, 2015.

Final Office Action for U.S. Appl. No. 14/657,837 dated Nov. 2, 2015.

International Search Report and Written Opinion for PCT/US2012/042314 dated Jun. 13, 2012.

European Search Report for PCT/US2012/042314 dated Jan. 29, 2015.

International Search Report and Written Opinion for PCT/US2012/041906 dated Jan. 31, 2013.

European Search Report, EP 12800672, dated Oct. 16, 2014.

Non-Final Office Action in U.S. Appl. No. 15/177,095 dated Jul. 24, 2017.

Restriction Requirement for U.S. Appl. No. 15/177,084 dated Aug. 18, 2017.

Notice of Allowance for U.S. Appl. No. 15/177,095 dated Nov. 16, 2017.

Final Office Action for U.S. Appl. No. 14/032,931 dated Jul. 7, 2017.

Non-Final Office Action for U.S. Appl. No. 14/681,874 dated Jun. 15, 2016.

Patent Owner's Preliminary Response for Case No. IPR2015-01690 Dated Nov. 13, 2015.

Patent Owner's Preliminary Response for Case No. IPR2015-01691 dated Nov. 18, 2015.

Notice of Allowance for U.S. Appl. No. 14/657,837 dated Apr. 12, 2016.

Petition for Inter Partes Review of U.S. Pat. No. 8,024,901, IPR2015-01690, filed Aug. 7, 2015.

Petition for Inter Partes Review of U.S. Pat. No. 8,024,901, IPR2015-01691, filed Aug. 7, 2015.

International Search Report for application No. EP17189630.1 dated Dec. 12, 2017.

Non-Final Office Action for U.S. Appl. No. 15/177,084 dated Jan. 29, 2018.

Non-Final Office Action for U.S. Appl. No. 14/305,819 dated Jul. 11, 2017.

Final Written Decision (IPR2015-01691), *Allsteal* v. *DIRTT Environemtnal Solutions* dated Jan. 19, 2017.

Decision Denying Institution (IPR2015-01690), *Allsteel* v. *DIRTT Environmental Solution* dated Jan. 27, 2016.

Office Action for U.S. Appl. No. 14/032,931 dated Jul. 16, 2015.

Notice of Allowance for U.S. Appl. No. 29/492,776 dated Jan. 21, 2016.

Notice of Allowance for U.S. Appl. No. 29/493,280 dated Jan. 21, 2016.

Genius Architectural Walls, [Publication Date Unlisted], Copyright Date 2004 by KI, Document Code KI-00473/HC/IT/PP/504.

KI Improves STC Rating on its Genius Architectural Wall and receives ICC approval, [Publication Date Unlisted], Dated Feb. 26, 2004.

Lifespace Environmental Wall Systems, Published Apr. 1995.

Press Release—"KI unveils Genius Full Heigth Movable Wall Microsite with new interactive features", Accessed on Aug. 14, 2015 at http://web.archive.org/web/20040506230219/http://www.ki.com/about_press_release.asp?id=49.

Office Insight, Published Mar. 23, 2009.

(56) References Cited

OTHER PUBLICATIONS

KI Genius Full-Height Moveable Walls, [Publication Date Unlisted], Copyright Date 2003 by KI, Document Code KI-00506/HC/PP/803.
U.S. Specifier Guide and Price Book, Published Jan. 1998.
Achieving the Atkins Aesthetic: KI's new ThinLine option for its award-winning Genius Architectural Wall flaunts a slimmer figure, [Publication Date Unlisted], Dated Jun. 14, 2004.
SMED International—Lifespace—Technical Information, Published Jan. 1, 1996.
Teknionaltos—Price and Product Guide Update, Published Feb. 2002.
Office Action for U.S. Appl. No. 14/681,874 dated Jul. 23, 2015.
Final Office Action for U.S. Appl. No. 14/032,931 dated Dec. 16, 2019.
Declaration of Robert Witti, Exhibit No. 1033 (IPR2015-01691), *Allsteel* v. *DIRTT Environmental Solutions*, dated Jul. 21, 2016.
Deposition of Joseph J. Beaman, Jr., Exhibit No. 2003 (IPR2015-01691), *Allsteel* v. *DIRTT Environmental Solutions*, dated Apr. 1, 2016.
European Communication pursuant to Article 94(3) EPC for European Application No. 17189630.1, dated Jul. 1, 2019, 13 pages.
European Communication pursuant to Article 94(3) EPC for European Application No. 17189630.1, dated Dec. 11, 2018, 8 pages.
Ex Parte Quayle Action received for U.S. Appl. No. 14/032,931, mailed on Jul. 24, 2020, 6 pages.
Exhibit 2010 Oral Deposition of Joseph J. Beaman Jr., Ph.D. (IPR2015-01691), *Allsteel* v. *DIRTT Environmental Solutions*, dated Nov. 18, 2018.
Expert Declaration of Joseph J. Beaman, Jr., Exhibit No. 1018 (IPR2015-01691), *Allsteel* v. *DIRTT Environmental Solutions*, dated Aug. 5, 2015.
Final Office Action for U.S. Appl. No. 14/681,874 dated Apr. 15, 2016.
Final Written Decision on Remand (IPR2015-01691), *Allsteel* v. *DIRTT Environmental Solutions*, dated Apr. 22, 2019.
Patent Owners Response (IPR2015-01691), *Allsteel* v. *DIRTT Environmental Solutions*, dated May 2, 2016.
Patent Owners Response to Petitioners Supplemental Brief Addressing Newly Instituted Claims 8, 11, 13, and 21-23 (IPR2015-01691), *Allsteel* v. *DIRTT Environmental Solutions*, dated Nov. 28, 2018.
Petitioners Reply to Patent Owners Responsive Brief (IPR2015-01691), *Allsteel* v. *DIRTT Environmental Solutions*, dated Dec. 12, 2018.
Petitioners Supplemental Brief Addressing Newly Instituted Claims 8, 11, 13 and 21-23 (IPR2015-01691), *Allsteel* v. *DIRTI Environmental Solutions*, dated Oct. 19, 2018.
Reply Declaration of Joseph J. Beaman, Jr., Exhibit No. 1032 (IPR2015-01691), *Allsteel* v. *DIRTT Environmental Solutions*, dated Jul. 21, 2016.
Reply to Patent Owners Response (IPR2015-01691), *Allsteel* v. *DIRTI Environmental Solutions*, dated Jul. 21, 2016.
Supplemental Declaration of Joseph J. Beaman Jr. (IPR2015-01691), *Allsteel* v. *DIRTT Environmental Solutions*, dated Oct. 19, 2018.

* cited by examiner

MODULAR WALLS INCORPORATING RECESSED, EXTENDABLE FURNITURE

CROSS-REFERENCE TO RELATED APPLICATIONS

The present application is a continuation of U.S. application Ser. No. 13/582,978, filed Sep. 5, 2012, and of U.S. application Ser. No. 29/493,280, filed Jun. 6, 2014. U.S. application Ser. No. 29/493,280 is a continuation of U.S. application Ser. No. 13/582,978. U.S. application Ser. No. 13/582,978 is a 35 U.S.C. § 371 National Stage of PCT/US12/42314, filed Jun. 13, 2012, which claims the benefit of priority to U.S. Provisional Application No. 61/581,002, filed Dec. 28, 2011. The entire content of the aforementioned patent applications is incorporated herein by reference.

BACKGROUND OF THE INVENTION

1. Field of the Invention

This invention generally relates to modular wall systems. More specifically, the present invention relates to modular wall systems including recessed, extendable furniture, such as beds, desks, and chairs.

2. Background and Relevant Art

Office space can be relatively expensive due to the basic costs of the location and size of the office space. In addition to these costs, an organization may incur further expense configuring the office space in a desirable layout. An organization might purchase or rent a large open space in a building, and then subdivide or partition the open space into various offices, conference rooms, or cubicles. Rather than having to find new office space and move as an organization's needs change, it is often desirable to reconfigure the existing office space. Many organizations address their configuration and reconfiguration issues by dividing large, open office spaces into individual work areas using modular wall segments (or wall modules) and partitions.

In particular, at least one advantage of modular wall systems is that they are relatively easy to configure. In addition, modular wall systems can be less expensive to set up and can allow for reconfiguration more easily than more permanently constructed office dividers. For example, an organization can construct a set of offices and a conference area within a larger space in a relatively short period of time with the use of modular wall systems. If office space needs change, the organization can readily reconfigure the space.

In general, modular office partitions typically include a series of individual wall modules (and/or panels). The individual wall modules are typically free-standing or rigidly attached to one or more support structures. In particular, a manufacturer or assembler can usually align and join the various wall modules together to form an office, a room, a hallway, or otherwise divide an open space.

While conventional modular wall systems can provide various advantages, such as those described above, conventional modular wall systems are limited in design choices. For example, conventional modular wall systems typically do not allow for inclusion of built-in extendable objects (such as beds or desks) within a wall module. This is not surprising considering that conventional modular walls are typically only four inches wide, and thus, provide no room for housing such objects.

Wall beds (i.e. Murphy beds) are often built into a traditional solid wall or provided within a separate piece of furniture such as a bookcase. When built into a solid wall, a wall bed becomes a permanent feature of a room, and thus, does not allow for reconfiguration. Furthermore, although a wall bed provided within a separate piece of furniture can be rearranged within, or removed, from a room, the furniture is separate from the wall and therefore occupies a large area of space within the room.

Accordingly, there are a number of disadvantages with conventional wall systems that can be addressed.

BRIEF SUMMARY OF THE INVENTION

Implementations of the present invention solve one or more of the foregoing or other problems in the art with systems, methods, and apparatus for incorporating furniture (e.g., beds, desks, chairs) into modular walls. In particular, one or more implementations include modular walls having recessed, extendable furniture incorporated therein. The recessed, extendable furniture can move between a closed position and an open or extended position. When in the closed position, the furniture is concealed within the modular wall. Furthermore, these systems and components enable quick and efficient assembly, disassembly, and reconfiguration of wall modules including furniture with great ease. Accordingly, implementations of the present invention can be easily adapted to the environment of use and provide a number of secure mounting options.

For example, an implementation of a wall module includes a pair of vertical frame brackets configured to removably couple the wall module to one or more additional wall modules to form a reconfigurable modular wall. The wall module further includes an interior wall connecting the pair of vertical frame brackets together. The interior wall defines a pocket recessed behind the pair of vertical frame brackets. Also, the wall module includes a recessed, extendable piece of furniture. The recessed, extendable piece of furniture is configured to be contained within the pocket when in a recessed position. The recessed, extendable piece of furniture is also configured to extend from the pocket to a generally horizontal position when in an extended position.

Additionally, another implementation of a wall module includes an interior frame comprising one or more vertical frame brackets and one or more horizontal frame brackets. The interior frame is configured to removably couple the wall module to one or more additional wall modules to form a reconfigurable modular wall. The wall module further includes a recessed, extendable bed pivotally coupled directly to the interior frame. The recessed, extendable bed is configured to move between a recessed position within the wall module and an extended position in which the recessed, extendable bed extends generally horizontally from the wall module.

In addition to the foregoing, an implementation of a modular wall includes a plurality of wall modules. Each of the wall modules includes an interior frame and one or exterior tiles removably coupled to the interior frame. The interior frames of each of the wall modules allow the wall modules to be selectively connected to an interior frame of another wall module to form the modular wall. Additionally, the interior frames of each of the wall modules allow the wall modules to be selectively repositioned or rearranged relative to each other. The modular wall further includes a recessed, extendable piece of furniture positioned in at least one wall module of the plurality of wall modules. The recessed, extendable piece of furniture is configured to move between a recessed position within the at least one wall module and an extended position in which the recessed, extendable piece of furniture extends generally horizontally from the at least one wall module.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems, methods, and apparatus for incorporating furniture (e.g., beds, desks, chairs) into modular walls. In particular, one or more implementations include modular walls having recessed, extendable furniture incorporated therein. The recessed, extendable furniture can move between a closed position and an open or extended position. When in the closed position, the furniture is concealed within the modular wall. Furthermore, these systems and components enable quick and efficient assembly, disassembly, and reconfiguration of wall modules including furniture with great ease. Accordingly, implementations of the present invention can be easily adapted to the environment of use and provide a number of secure mounting options.

In particular, implementations of the present invention provide modular wall systems with increased width. The increased width can provide space within the wall for housing recessed, extendable furniture therein. Thus, when in a closed or storage configuration, the furniture folds into or otherwise resides within a recessed pocket in the modular wall. When in the closed or storage configuration, the outer surface of the furniture forms an exterior surface of the wall module; thereby, concealing the furniture seamlessly into the modular wall. The exterior surface can comprise one or more exterior interchangeable tiles. When in an open or deployed position, the furniture can fold or otherwise extend out of the recessed pocket in the modular wall.

The recessed, extendable furniture can comprise a bed, a shelf, a desk, bunk beds, a chair, a table, or other furniture. Indeed, one will appreciate in light of the disclosure herein that the hardware, systems, and methods can allow an installer to seamlessly incorporate a wide variety of furniture within a modular wall. In particular, implementations of the present invention can allow an installer to incorporate furniture within a modular wall without having to add external framework or other aesthetically unpleasing hardware.

Throughout this specification, reference is made to wall modules of a modular wall system. A wall module can comprise an individual section of the modular wall system in which a manufacturer can attach and remove independently of other wall module sections of the modular wall system. For example, an existing installed wall system that does not include a wall module having recessed, extendable furniture may be retrofitted with a wall module having recessed, extendable furniture according to one or more implementations of the present invention. In particular, a user can replace an existing wall module in the installed wall without requiring the disassembly of the wall system. The invention, however, is not limited to retrofitting existing walls, but also extends to modular wall installations that include wall modules having recessed, extendable furniture at the time of initial installation.

Figure 1A:
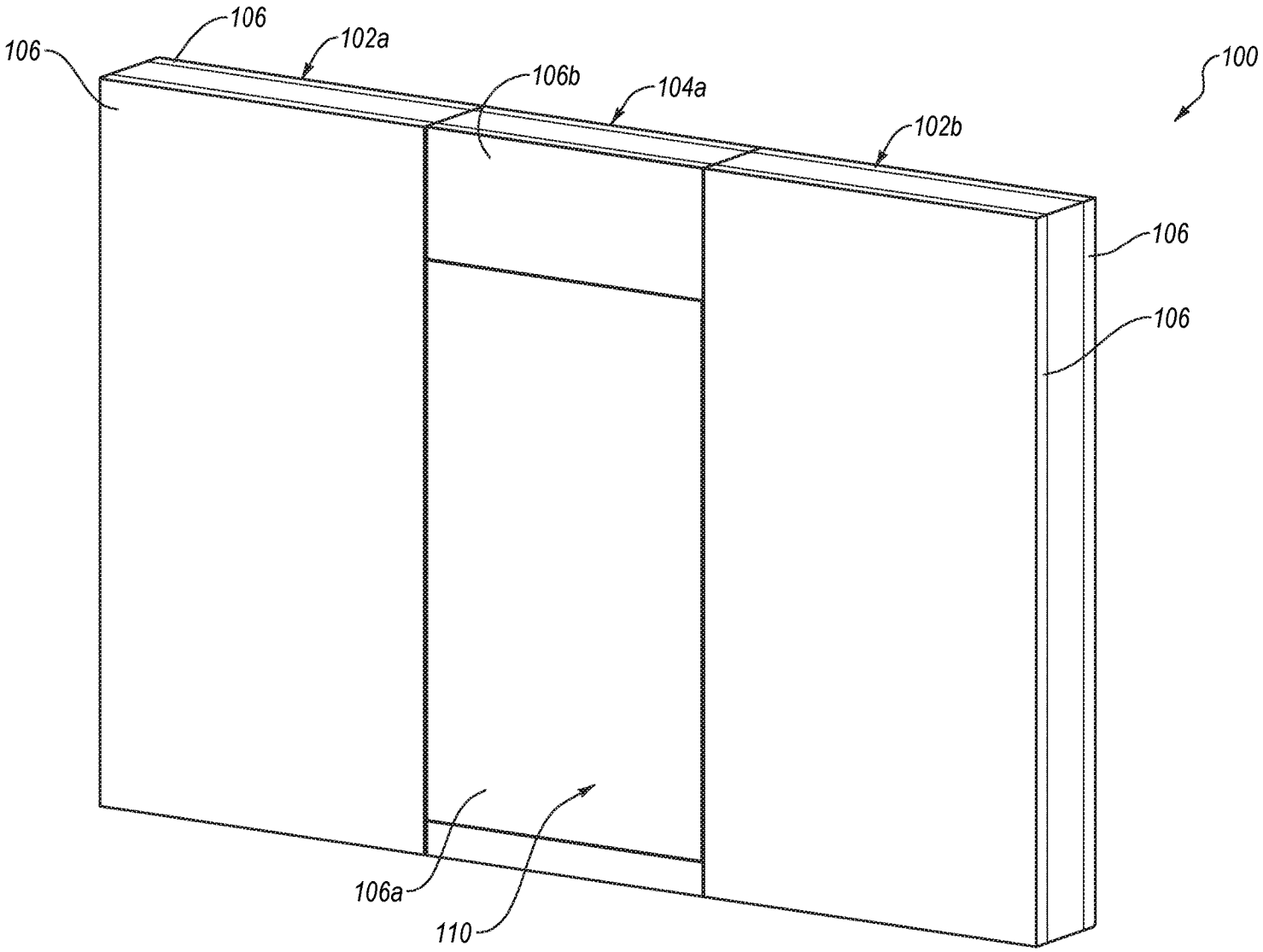
FIG. 1A illustrates a modular wall including a wall module having a recessed, extendable bed in a closed configuration according to one or more implementations of the present invention.
Figure 1B:
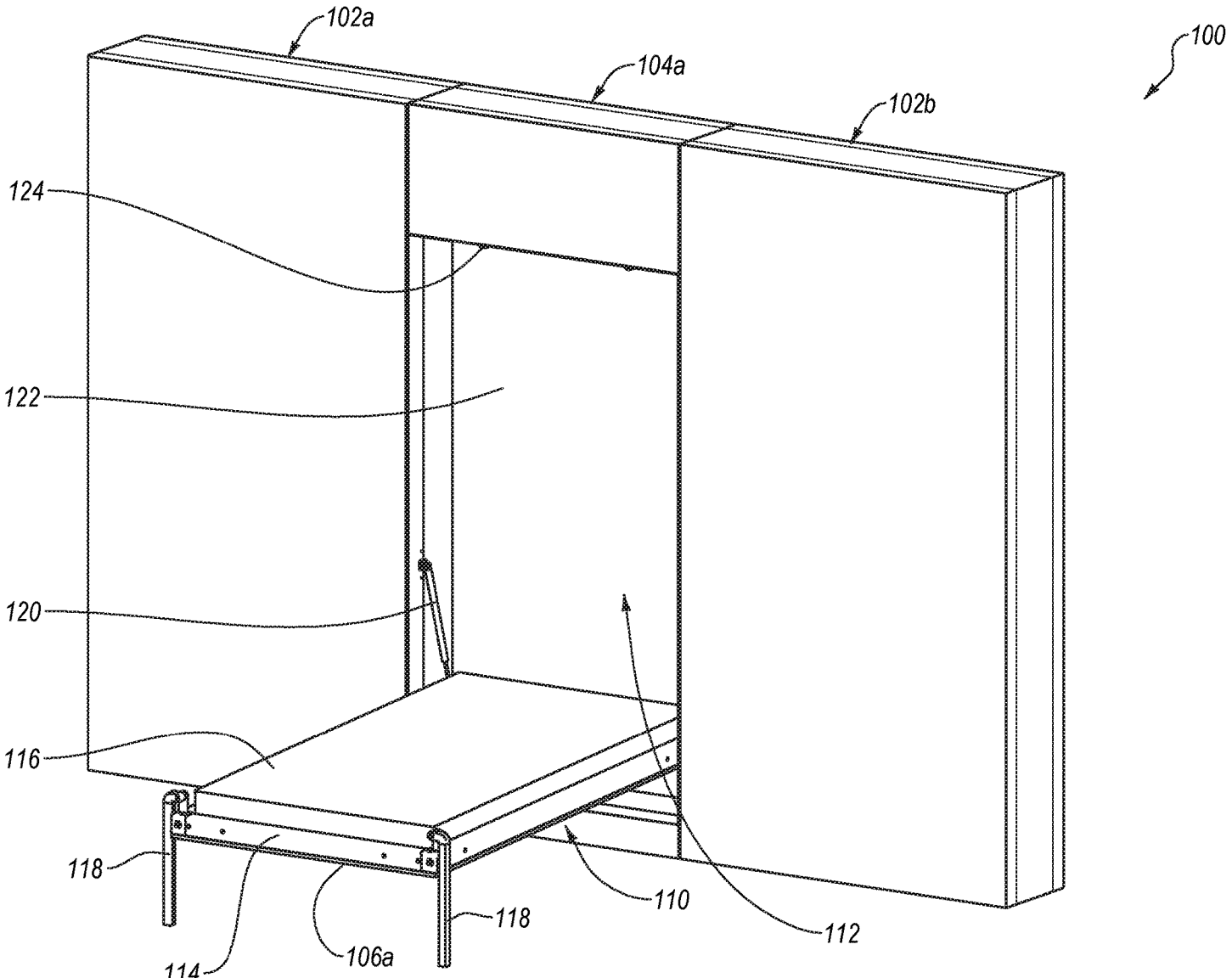
FIG. 1B illustrates the modular wall of FIG. 1A with the recessed, extendable bed in an open configuration.

For example, FIG. 1A and FIG. 1B illustrate a modular wall 100 consisting of a plurality of wall modules 102*a*, 102*b*, 104*a*. Each of wall modules 102*a*, 102*b*, 104*a* removably connect to any of the other wall modules 102*a*, 102*b*, 104*a*. Accordingly, a designer can reconfigure modular wall 100 by interchanging or replacing any wall module 102*a*, 102*b*, 104*a*.

Each wall module 102*a*, 102*b*, 104*a* can comprise an interior frame and one or more exterior tiles 106 connected to one or both sides of the wall module. Each wall module 102*a*, 102*b*, 104*a* includes exterior tiles 106 on each side of the wall module 102*a*, 102*b*, 104*a*. Thus, modular wall 100 can divide a room or other space. In alternative implementations, one side of the modular wall 100 can include no tiles, for example, if the modular wall 100 is positioned against another structure, such as a structural wall.

In any event, as shown by FIG. 1A and FIG. 1B, wall module 104*a* can include a recessed, extendable piece of furniture, in this case a recessed, extendable bed 110. As shown by FIG. 1A, when in the closed or storage position, the recessed, extendable bed 110 can seamlessly fit within the modular wall 100. In particular, the external tile(s) 106*a* attached to the underside of the recessed, extendable bed 110 can help ensure that the wall module 104*a* appears similar to the wall modules 102*a*, 102*b* without recessed, extendable furniture.

FIG. 1A illustrates that the recessed, extendable bed 110 includes a single exterior tile 106*a* attached thereto. In alternative implementations, the recessed, extendable bed 110 can have a plurality of external tiles 106*a* attached thereto. Whether single or multiple tiles are used, the external tiles 106*a* can remain interchangeable. FIG. 1A further illustrates that the wall module 104*a* can include an external tile 106*b* positioned above the recessed, extendable bed 110. In any event, in one or more implementations all of the external tiles 106, 106*a*, 106*b* can align so as to be substantially flush.

Referring now specifically to FIG. 1B, the recessed, extendable bed 110 is shown in the deployed or extended position. As shown, the recessed, extendable bed 110 can extend out from a pocket 112 within the wall module 104*a*. The pocket 112 thus can allow the exterior tile 106*a* on the underside of the recessed, extendable bed 110 to align flush with the exterior tiles 106 of adjacent wall modules 102*a*, 102*b* as shown by FIG. 1A.

The recessed, extendable bed 110 can include a bed frame 114, a mattress 116, one or more supports (e.g., legs 118), and one more lifting and lowering mechanisms 120. As explained in greater detail below, the bed frame 114 can couple directly to the interior frame of wall module 104*a*. Similarly, lifting and lowering mechanisms 120 can also couple to, and extend between, the interior frame of the wall module 104*a* and the bed frame 114.

The lifting and lowering mechanism 120 can comprise a pneumatic piston, a gas spring, a torsion spring or other mechanism. One will appreciate that mechanism 120 can be configured in at least one implementation for storing energy as the recessed, extendable bed 110 is lowered, and for releasing energy as the recessed, extendable bed 110 is raised. Thus, the lifting and lowering mechanism 120 can limit how quickly the recessed, extendable bed 110 lowers towards the floor. Furthermore, the lifting and lowering mechanism 120 can aid in raising the recessed, extendable bed 110 from the extended position to the storage or recessed position.

Once lowered into a generally horizontal configuration, one or more supports can support the recessed, extendable bed 110 from the floor. For example, FIG. 1B illustrates that legs 118 can support the recessed, extendable bed 110 from the floor. As explained in greater detail below, the legs 118 can pivot down from corners of the bed frame 114 to the floor to provide additional support. While FIG. 1B illustrates legs 118 positioned at the corners of the bed frame 114, the preset invention is not so limited. For example, in alternative implementations the recessed, extendable bed 110 can include legs in any position along the bed frame 114.

When recessed, extendable bed 110 is folded down out of wall module 104*a*, and the recessed cavity or pocket 112 is exposed. The recessed pocket 112 can include one or more tiles 122 on the back surface or can include one or more sides of the recessed pocket 112. The tile(s) 122 can serve both aesthetic and functional purposes. These tiles 122 can couple to the interior frame of the corresponding wall module 104*a* and can allow for replacement or repositioning, similar to external tiles 106. For example, tile 122 can attach to the interior frame of wall module 104*a* to form a back wall of the recessed pocket 112. As desired, a user can exchange tile 122 in recessed pocket 112 for another tile to change the aesthetic of the recessed pocket 112. The interchangeability of the tiles 122 can enable the customization of the recessed pocket 112.

In addition to tiles 122, the recessed pocket 112 can also optionally include one or more fixtures. For example, the recess pocket 112 can include lights 124. In alternative implementations, fixtures within the recessed pocket 112 can include televisions, touch screen devices such as a smart phone, computer, or music device, shelves, artwork, etc. Additionally, to enable the use of electronic fixtures within the recessed pocket 112, the recessed pocket 112 can provide electronic connectors at each opening where fixtures are to be installed. For example, an opening can include an electrical outlet for receiving a portion of a light fixture's connector to provide power to the light fixture. Similarly, an opening may also provide one or more data connectors (e.g. HDMI, Coax, USB, Ethernet, etc.) that conform to one or more corresponding data connectors of a television module, a touch screen computer module, or similar module that requires data communication.

In one or more implementations of the present invention, fixtures (such as a light fixture) can protrude from the tiles 122 within the recessed pocket 112. For example, a light fixture 124 can be repositionable between a flush and a protruded position. In one implementation, a light fixture 124 can provide for manual repositioning (e.g. by pushing in on the light fixture to release the light fixture into the protruded position).

In another implementation, the position of a light fixture (or another device) is controlled by the position of the corresponding bed. For example, a light fixture 124 within the upper portion of the recessed pocket 112 can move to a protruded position when the recessed, extendable bed 110 is folded down out of wall module 104*a*. Similarly, when recessed, extendable bed 110 is raised, the light fixture 124 can return to a flush configuration.

Figure 1C:
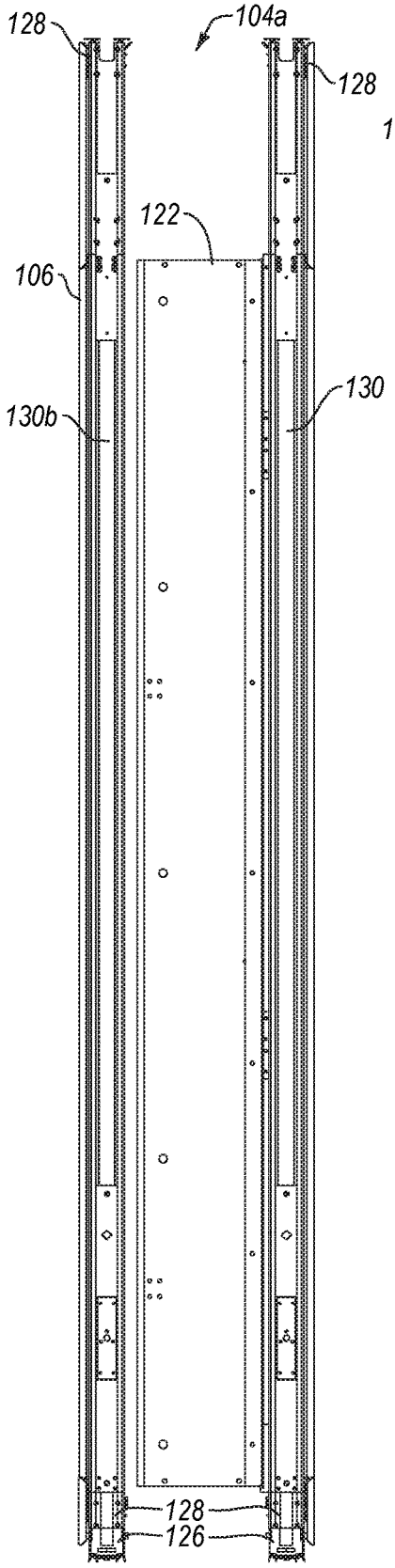
FIG. 1C illustrates an end view of the wall module of FIG. 1A with the recessed, extendable bed in a closed configuration.
Figure 1D:
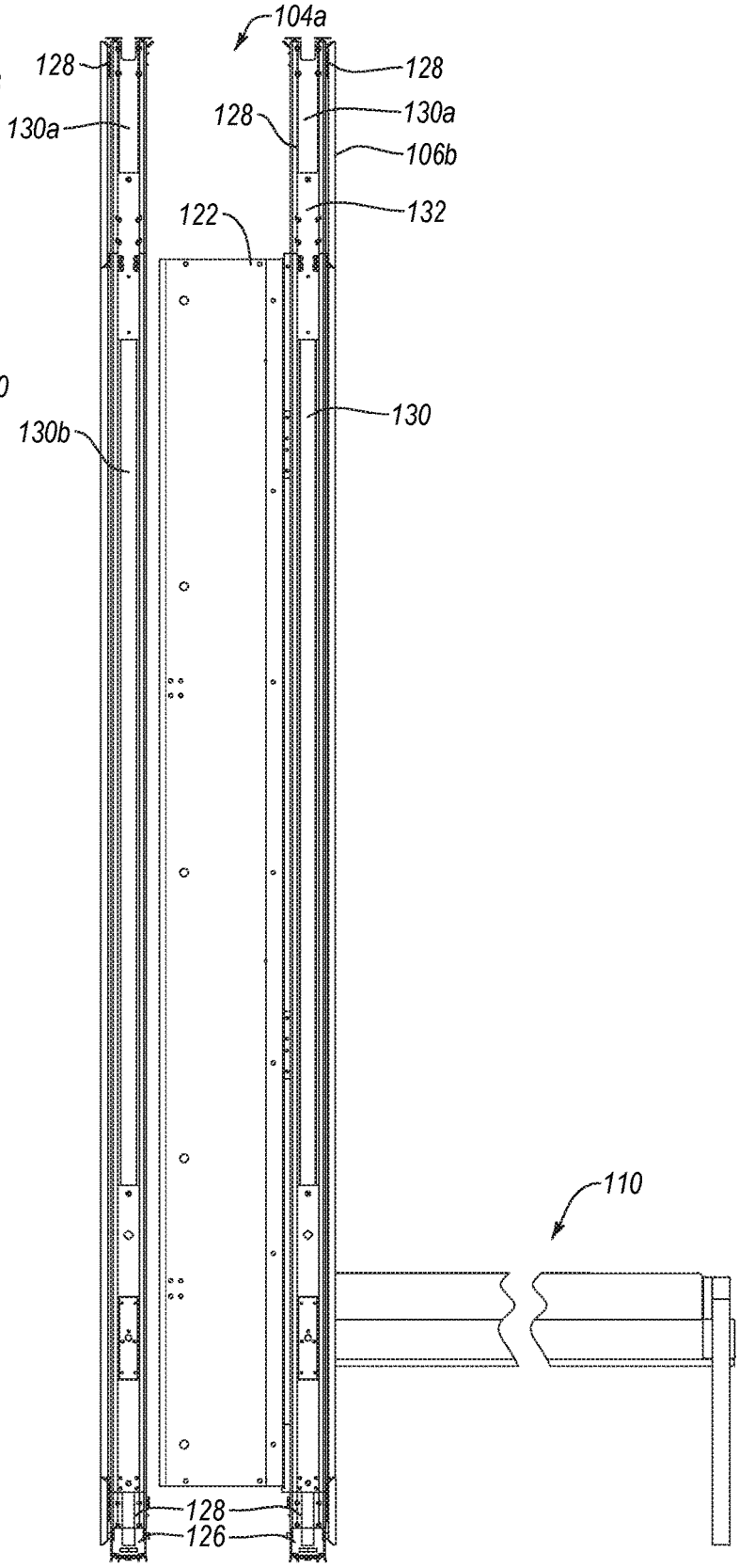
FIG. 1D illustrates an end view of the wall module of FIG. 1A with the recessed, extendable bed in an open configuration.

As mentioned previously, implementations of the present invention can provide modular walls with increased width to accommodate recessed, extendable furniture. For example, FIGS. 1C and 1D illustrate end views of the wall modules 104*a*. As shown, the wall module 104*a* can include vertical frame brackets 130. Furthermore, an interior wall can connect the pair vertical frame brackets 130 together. The interior wall can include one or more tiles 122 that define the recessed pocket 112. In other words, each end of the wall module 104*a* can include a vertical frame bracket 130, and the wall panels or tiles 122 can extend therebetween.

Additionally, to extend the height of the wall module 104*a*, splines 132 can attach additional vertical frame brackets 130*a* to vertical frame brackets 130. Then exterior tiles 106 can couple to vertical frame brackets 130*a* via horizontal frame brackets. Additionally, the wall module 104*a* can include one or more leveler assemblies 126. The lever assemblies 126 can allow a user to level, raise, or lower the wall module 104*a* by adjusting a bolt along a treaded rod.

The interior frame of the wall module 104*a* can further include one or more horizontal frame brackets 128. The horizontal frame brackets 128 can extend between the vertical frame brackets 130. Furthermore, the horizontal frame brackets 128 can include one or more engagement protrusions (similar to engagement protrusions 138 described below in relation to FIG. 2). The engagement protrusions can allow a user to attach external tiles 106 to the interior frame. In particular, the external tiles 106 can include clips or connectors (similar to connectors 140 described below in relation to FIG. 2) that can couple to the engagement protrusions. In particular, the connectors can include one or more flexible arms that clip or snap about an arrow-shaped barb or head of the engagement protrusions to secure the external tiles 106 to the interior frame (i.e., horizontal frame brackets 128).

When the wall module 104*a* divides a space, a user can position a second set of vertical frame brackets 130*b*, horizontal frame brackets, and exterior tiles 106 to conceal the backside of the wall modules 104*a*. In alternative implementations, secondary vertical frame brackets 130 can attach to the back side of the wall panels or tiles 122 forming the recessed pocket 112. Such secondary vertical frame brackets 130 can then support horizontal frame brackets and exterior tiles 106. In still further implementations, the back side of the wall module 104*a* can abut against an existing wall.

Figure 2:
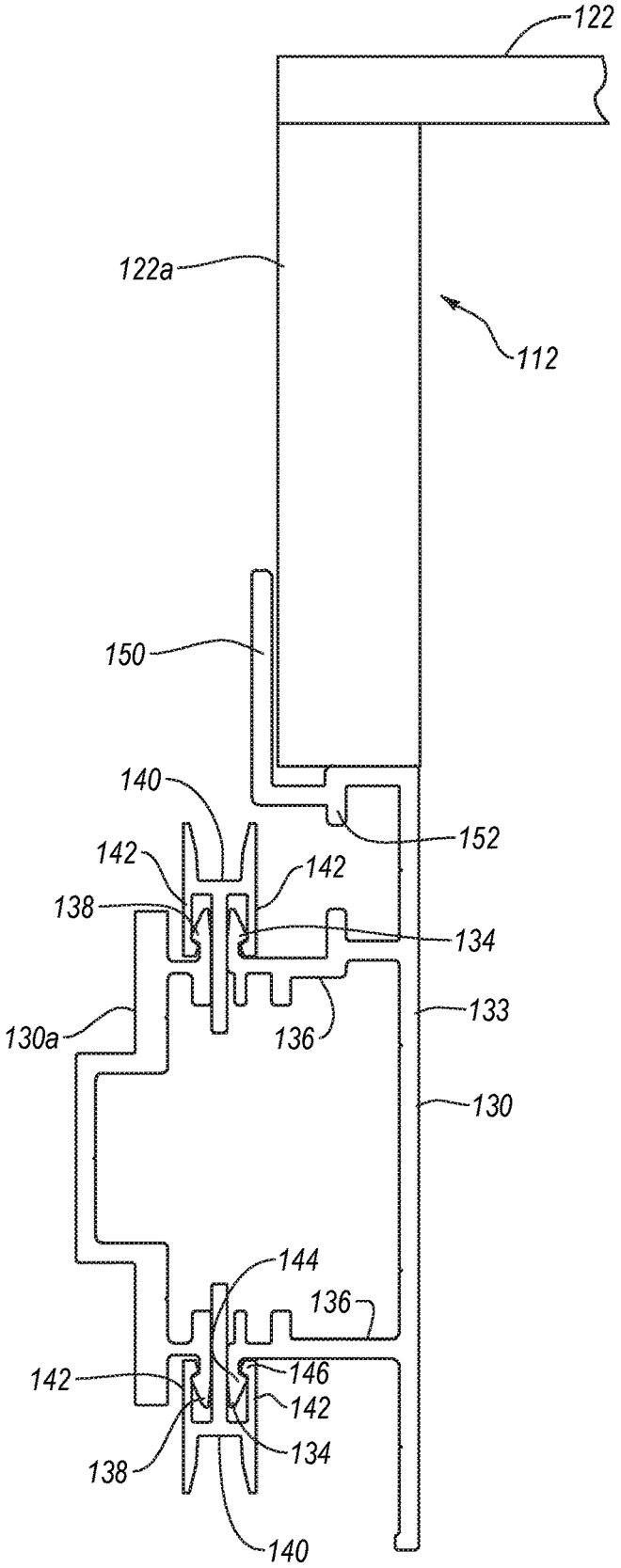
FIG. 2 illustrates a top view of a vertical frame bracket and pocket of the modular wall including a recessed, extendable bed of FIG. 1A.

Referring now to FIG. 2, the vertical frame bracket 130 and how they attach to adjacent frames of other wall modules is described in greater detail. For example, as illustrated in FIG. 2, the vertical frame bracket 130 can include a generally planar wall body 133. The wall body 133 can act as the main support for the wall module 104*a*. In particular, as explained below, the wall body 133 can attach to and support the recessed, extendable bed 110, the wall panels 122 forming the recessed pocket 112, and adjacent wall modules 102*a*, 102*b*.

As shown by FIG. 2, the vertical frame bracket 130 can incorporate one or more engagement protrusions 134. In particular, as illustrated by FIG. 2, an L-shaped arm 136 can extend away from the wall body 133 of the vertical frame bracket 130. Each arm 136 can hold an engagement protrusion 134 at the end thereof. The L-shaped arms 136 can point each of the engagement protrusions 134 away from each other.

In one or more implementations, the engagement protrusion 134 can comprise a barb or an arrow-shaped head. The engagement protrusions 134 can allow the vertical frame bracket 130 to couple to the vertical frame bracket 130*a* of an adjacent wall module (e.g., 102*a*, 102*b*). In particular, the vertical frame bracket 130*a* of an adjacent wall module can include corresponding engagement protrusions 138. A clip or connector 140 can couple the engagement protrusions 134, 138 of the adjacent vertical frame brackets 130, 130*a* together. In particular, the clip or connector 140 can include one or more flexible arms 142 that clip or snap about the head of engagement protrusions 134, 138 to secure them together. In particular, the flexible arms 142 of the connectors 140 can surround at least a portion of the head of the engagement protrusions 134, 138. The ability to clip the vertical frame bracket 130 to the vertical frame bracket 130*a* of an adjacent wall module 130*a* can allow a user to selectively remove, move, or reconfigure the position of a wall module 104*a* within a given modular wall system.

As shown by FIG. 2, engagement protrusions or barbs 134 can include one or more undercutting edges 144. Accordingly, the undercutting edges 144 of the engagement protrusions or barbs 134 can couple to corresponding portions of the connectors 140. In particular, the flexible arms 142 of the connectors 140 can incorporate one or more undercutting lips 146. Thus, the undercutting edges 144 of the engagement protrusions 134 can mate with one or more undercutting lips 146 of the flexible arms 142. For instance, the flexible arms 142 can flex outward to allow the undercutting lips 146 to move around the undercutting edges 144 so that the undercutting lips 146 can snap about the engagement protrusions 134.

The vertical frame bracket 130 of the wall module with recessed, extendable furniture 104*a* can further include an attachment plate 150. The attachment plate 150 can comprise a surface extending generally parallel to, and away from the wall body 133. In particular, an extension 152 can offset the attachment plate 150 from the wall body 133. By being offset, the attachment plate 150 can accommodate a wall panel 122*a* and hold it flush with the wall body 133.

The wall panel 122*a* can attach to the attachment plate 150 via one or more fasteners, such as screws, nails, adhesive(s), etc. The attachment plate 150 can accommodate the wall panel 122*a* that forms the side of the recessed pocket 112 (FIG. 1B), and thus, allow for a wall module with increased width. A user can then attach a back tile 122 to the wall panel 122*a*. The back tile 122 can similarly be attached to another wall panel 122*a* on the other side of the recessed pocket 112.

Figure 3:
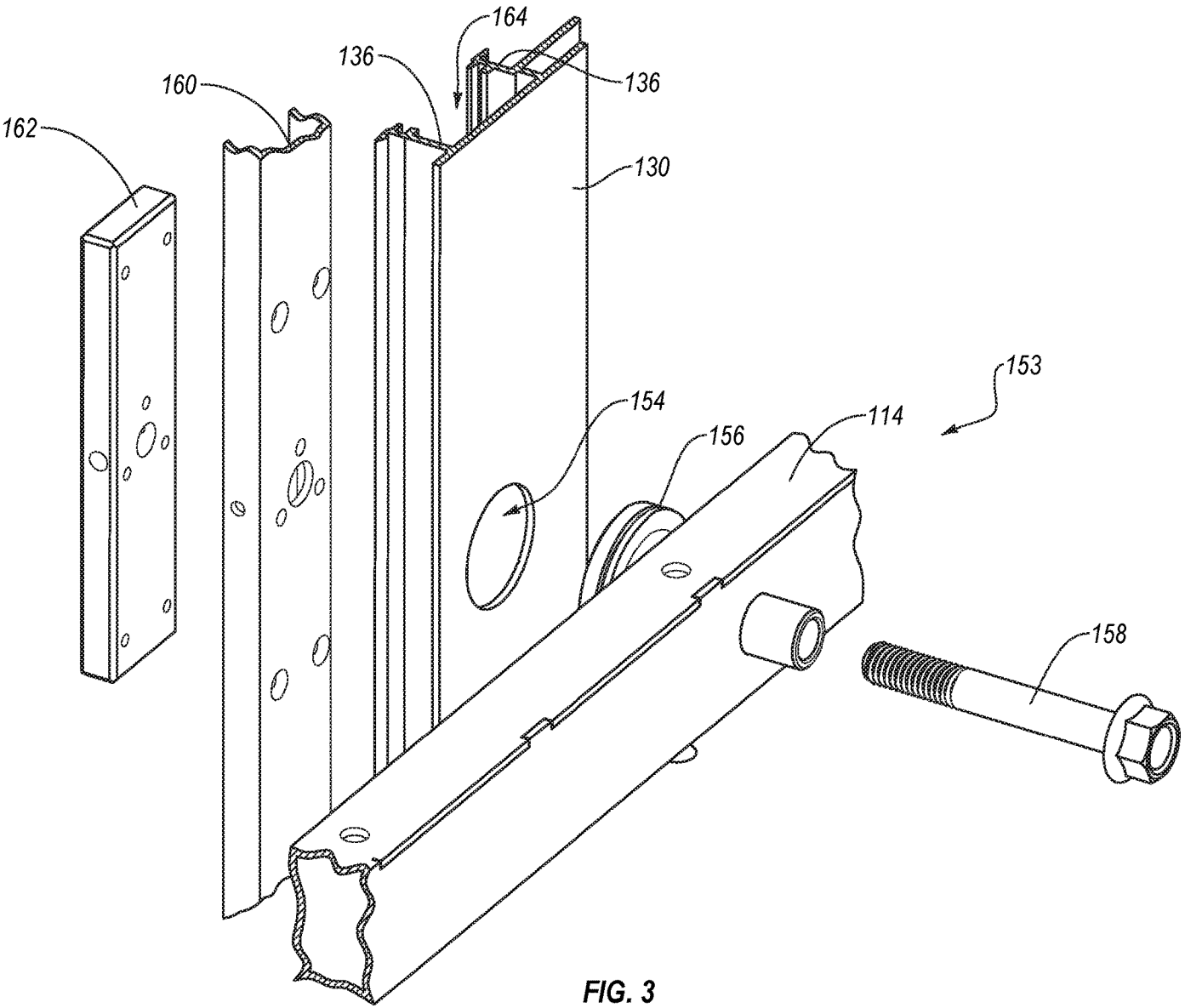
FIG. 3 illustrates an exploded view of the pivot connection of the modular wall including a recessed, extendable bed of FIG. 1A.

As mentioned previously, the vertical frame bracket 130 of the wall module with recessed, extendable furniture 104*a* can support the recessed, extendable bed 110. FIG. 3 illustrates an exploded view of a pivot connection 153 that can attach the recessed, extendable bed 110 to the vertical frame bracket 130. The pivot connection 153 can both support the weight of the recessed, extendable bed 110, and allow the recessed, extendable bed 110 to pivot relative to the vertical frame bracket 130.

The pivot connection 153 can include a pivot hub 156, a bolt or pivot rod 158, and one or more additional components. For example, FIG. 3 illustrates that the vertical frame bracket 130 can include a hole 154. The hole 154 can hold a pivot hub 156. The pivot hub 156 can also extend through the bed frame 114. In turn, a bolt or pivot rod 158 can extend through the pivot hub 156, through the hole 154 in the vertical frame bracket 130, through a stiffener plate 160, and attach to a hub plate 162.

The pivot hub 156 can pivot or rotate about the bolt or pivot rod 158 to allow the bed frame 114 to pivot or rotate relative to the vertical frame bracket 130. One will appreciate that the stiffener 160 and hub plate 162 can reside within a groove 164 between the arms 136 of the vertical frame bracket 130. Thus, the vertical frame bracket 130 can prevent the stiffener 160 and hub plate 162 from rotating relative to the vertical frame bracket 130.

One will appreciate that the specific pivot connection shown in FIG. 3 is only an exemplary pivot connection for attaching the bed frame 114 to the vertical frame bracket 130. Alternative implementations can include alternative configurations. For example, in one or more implementations the bolt or pivot rod 158 can attach directly to the vertical frame bracket 130. In such implementations, the pivot connection may not include a stiffener 160 and a hub plate 162. In still further implementations, the hole 154 in the vertical frame bracket 130 may accommodate only the bolt or pivot rod 158. In such implementations, a bushing or bearing can reside between the vertical frame bracket 130 and the pivot hub 156. In any event, the vertical frame bracket 130 can support the recessed, extendable bed 110.

Figure 4:
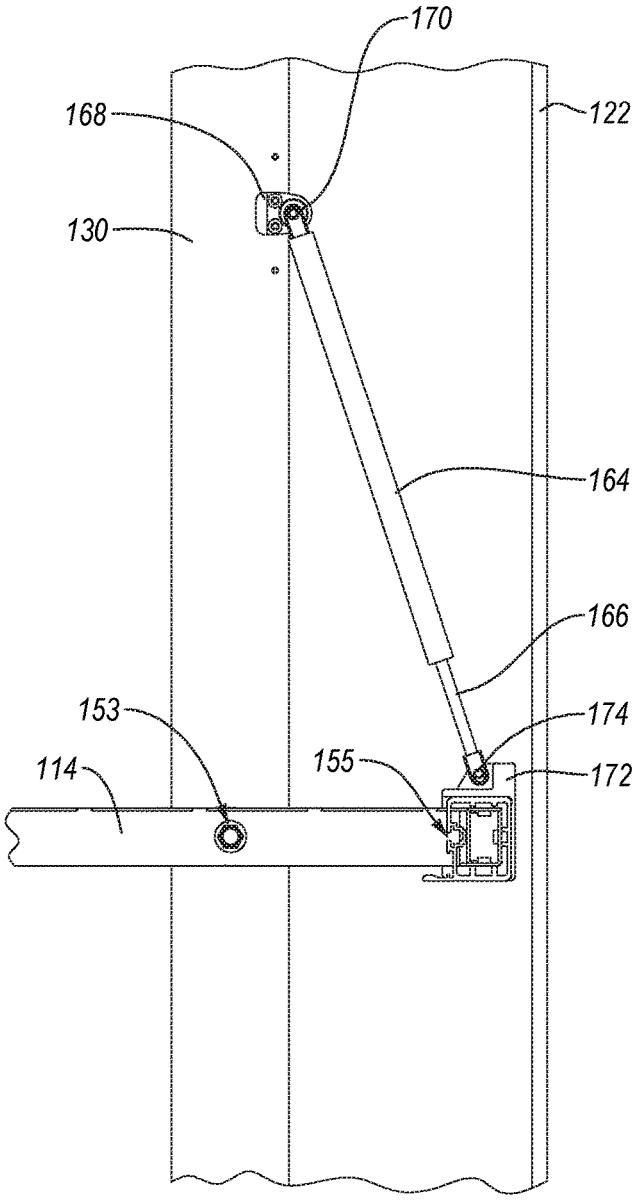
FIG. 4 illustrates a view of the piston and pivot connection of the recessed, extendable bed of FIG. 1A in the open configuration.
Figure 5:
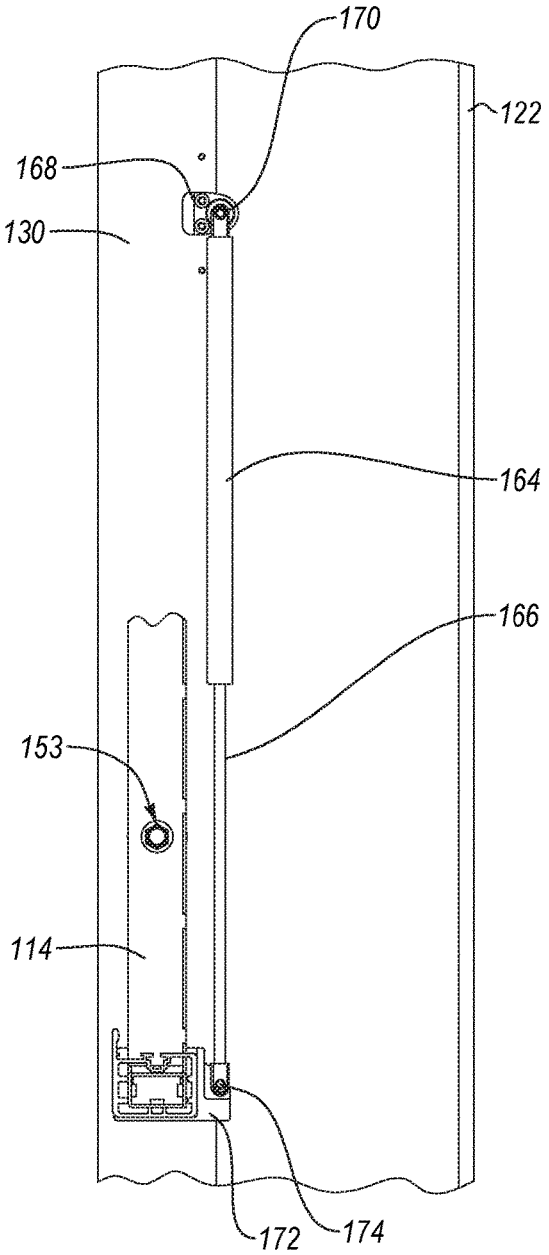
FIG. 5 illustrates a view of the piston and pivot connection of the recessed, extendable bed of FIG. 1A in the closed configuration.

In addition to the pivot connection 153, lifting and lowering mechanisms 120 can also couple to and extend between the interior frame (i.e., vertical frame bracket 130) of the wall module 104*a* and the bed frame 114. For example, FIGS. 4 and 5 illustrate views of the bed frame 114 in an extended or deployed position (FIG. 4), and the recessed or storage position (FIG. 5). As mentioned earlier, the lifting and lowering mechanism 120 can comprise a pneumatic piston, a gas spring, a torsion spring or other mechanism that can limit how quickly the recessed, extendable bed 110 is lowered towards the extended position. Furthermore, the lifting and lowering mechanism 120 can aid in raising the recessed, extendable bed 110 from the extended position to the storage or recessed position.

As shown in FIGS. 4 and 5 in one implementation, the lifting and lowering mechanisms 120 can each comprise a pneumatic piston. In particular, the lifting and lowering mechanism 120 can include a cylinder 164 and a rod 166 moveably coupled to the cylinder 164. The cylinder 164 can attach to the vertical frame bracket 130 via a support bracket 168 and a pivot pin 170. The pivot pin 170 can allow the cylinder 164 to rotate or pivot relative to the vertical frame bracket 130.

Similarly, the rod 166 can attach to the bed frame 114 via a support mount 172 and a pivot pin 174. The pivot pin 174 can allow the rod 166 to rotate or pivot relative to the bed frame 114. In one or more implementations, the support mount 172 is located near a rear corner of the bed frame 114. In alternative implementations, the support mount 172 is positioned along the side of the bed frame 114.

As shown by comparing FIGS. 4 and 5, when in the storage position, the lifting and lowering mechanism 120 can extend approximately vertically, and the support mount 172 can reside directly (or substantially directly) below support bracket 130. As the bed frame 114 rotates out to the extended position, the bed frame 114 can rotate about the pivot connection 153 such that the support mount 172 moves up and toward the back tile 122. As the bed frame 114 rotates out to the extended position, the rod 166 can retract into the cylinder 164.

In any event, the lifting and lowering mechanism 120 can help ensure that the recessed, extendable furniture is not lowered too fast. Additionally, the lifting and lowering mechanism 120 can assist in raising the recessed, extendable furniture to the storage position. One will appreciate that FIGS. 3, 4, and 5 illustrate one side of the interior of the wall module 104*a* with recessed, extendable furniture. The other side can include the same components and functions. Thus, two separate pivot connections 153 on each side of the recessed pocket 112 can attach both sides of the bed frame 114 to the vertical frame bracket 130. Similarly, two separate lifting and lowering mechanisms 120 on each side of the recessed pocket 112 can attach both sides of the bed frame 114 to the vertical frame bracket 130.

FIG. 4 further illustrates that the bed frame 114 can include a channel 155 therein. The channel 155 can allow a user to attach other components, such as straps, to the bed frame 114. For example, a user can extend a strap between the channel 155 of the bed frame 114 and the interior frame of the wall module 104*a* to support the recessed, extendable bed 110 in the extended position. The strap can replace the legs 118 or act as a secondary support.

The channel 155 can comprise include an opening that is smaller than the actual channel 155. Thus, the walls forming the opening of the channel 155 can act to retain a clip, connector, or portion of a strap within the channel 155. The channel 155 can extend around the entire inner surface of the bed frame 114. In alternative implementations, the channel 155 can extend along only a portion of the bed frame 114 (such as the end of the bed frame 114 between the corners 194). In any event, in one or more implementations the mattress 116 can cover or otherwise conceal the channel 155 from view.

Figure 7:
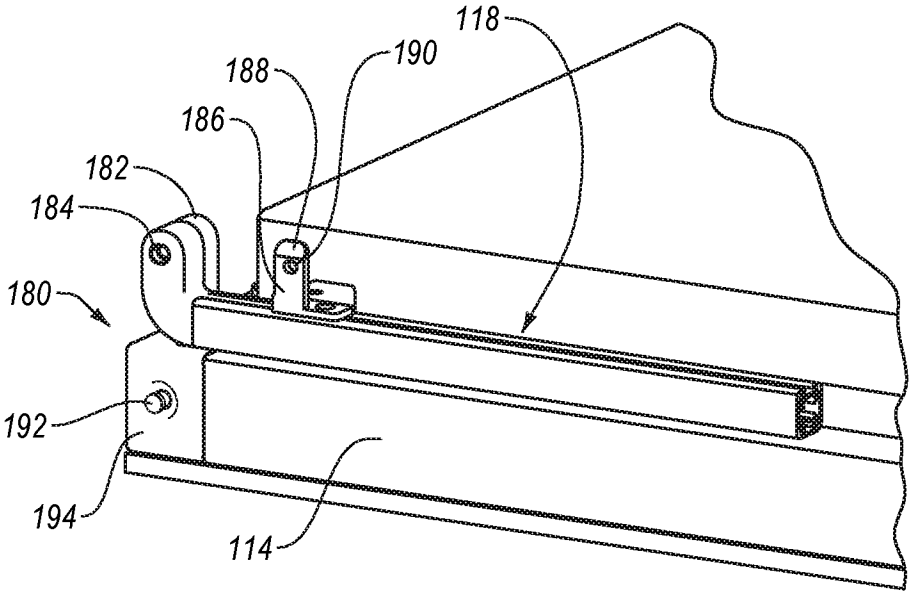
FIG. 7 illustrates a view of the leg of the recessed, extendable bed of FIG. 1A in a storage position.
Figure 6:
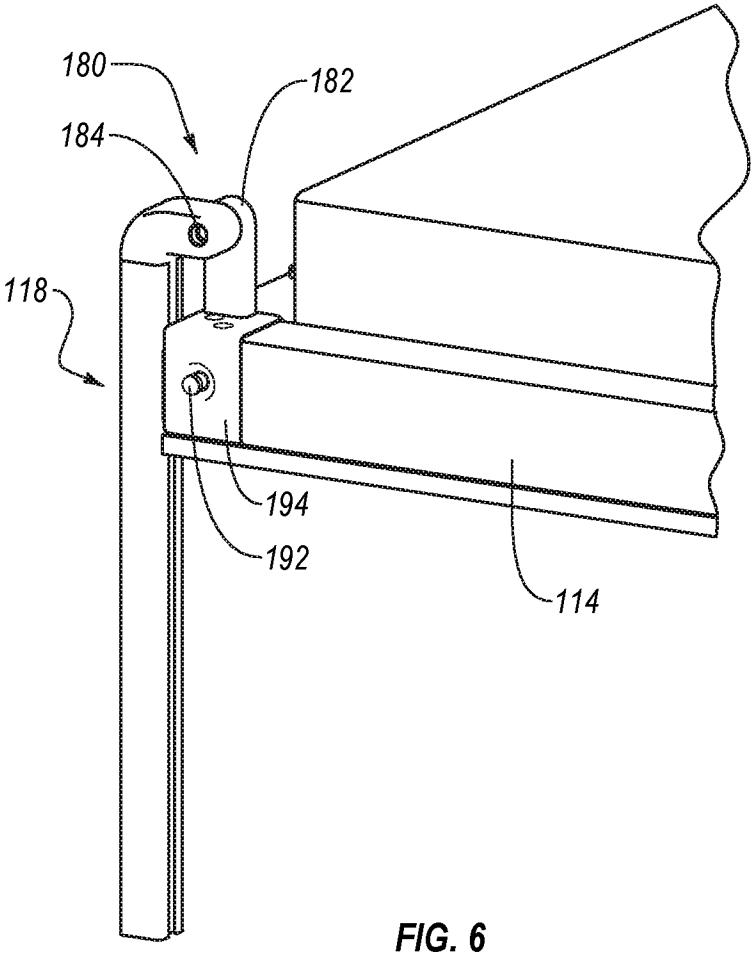
FIG. 6 illustrates a view of the leg of the recessed, extendable bed of FIG. 1A in a deployed position.

As mentioned previously, the recessed, extendable bed 110 can further include one or more supports when lowered into the extended position. For example, FIGS. 6 and 7 illustrate a leg 118 on one corner of the recessed, extendable bed 110 in a deployed position (FIG. 6) and a storage position (FIG. 7). When in the deployed position, the leg 118 can support the recessed, extendable bed 110, and prevent the recessed, extendable bed 110 from moving below a generally horizontal position. Furthermore, the ability to move to a storage position can allow the leg 118 to reside with the recessed pocket 112 when the recessed, extendable bed 110 is in the storage position (FIG. 1A).

FIGS. 6 and 7 illustrate that a pivot mechanism 180 can couple the leg 118 to the bed frame 114. In particular, a pivot post 182 can extend from the bed frame 114. A pivot pin 184 can couple the leg 118 to the pivot post 182 and allow the leg 118 to rotate between the deployed position (FIG. 6) and the storage position (FIG. 7).

In one or more implementations, the pivot mechanism 180 can further include a locking mechanism for securing the leg 118 in the deployed position (FIG. 6). For example, FIG. 7 illustrates that a locking bracket 186 can extend from the leg 118. The locking bracket 186 can include a tapered leading end 188 and a locking hole 190. The locking bracket 186 can interface with a locking pin 192 moveably positioned in a corner 194 of the bed frame 114.

In particular, the locking pin 192 can move between a locked position in which the locking pin 192 is fully inserted into the corner 194, and a release position in which the locking pin 192 is pulled partially out of the corner 194. A spring or other mechanism can bias the locking pin 192 toward the locked position. As the leg 118 is rotated toward the deployed position (FIG. 6), the tapered end 188 can enter into the corner 194 and push the locking pin 192 outward until the locking hole 190 aligns with the locking pin 192. When the locking hole 190 aligns with the locking pin 192, the locking pin 192 can automatically enter into the locking hole 190, thereby locking the leg 118 in the deployed position (FIG. 6).

To unlock the leg 118, a user can pull the locking pin 192 at least partially outward of the corner 192 so as to clear the locking hole 190. The user can then freely pivot the leg 118 about the pivot pin 184 into the storage position (FIG. 7). As shown by FIG. 7, when in the storage position, the leg 118 can extend from the corner 194 along the front of the bed frame 114 toward the opposite corner of the bed frame 114.

FIGS. 1-7 and the corresponding text describe and/or depict a wall module 104*a* including a recessed, extendable bed 110. One will appreciate in light of the disclosure herein that the present invention is not so limited. In particular, the features and components described above can also provide for multiple pieces of recessed, extendable furniture in a single wall module.

Figure 8A:
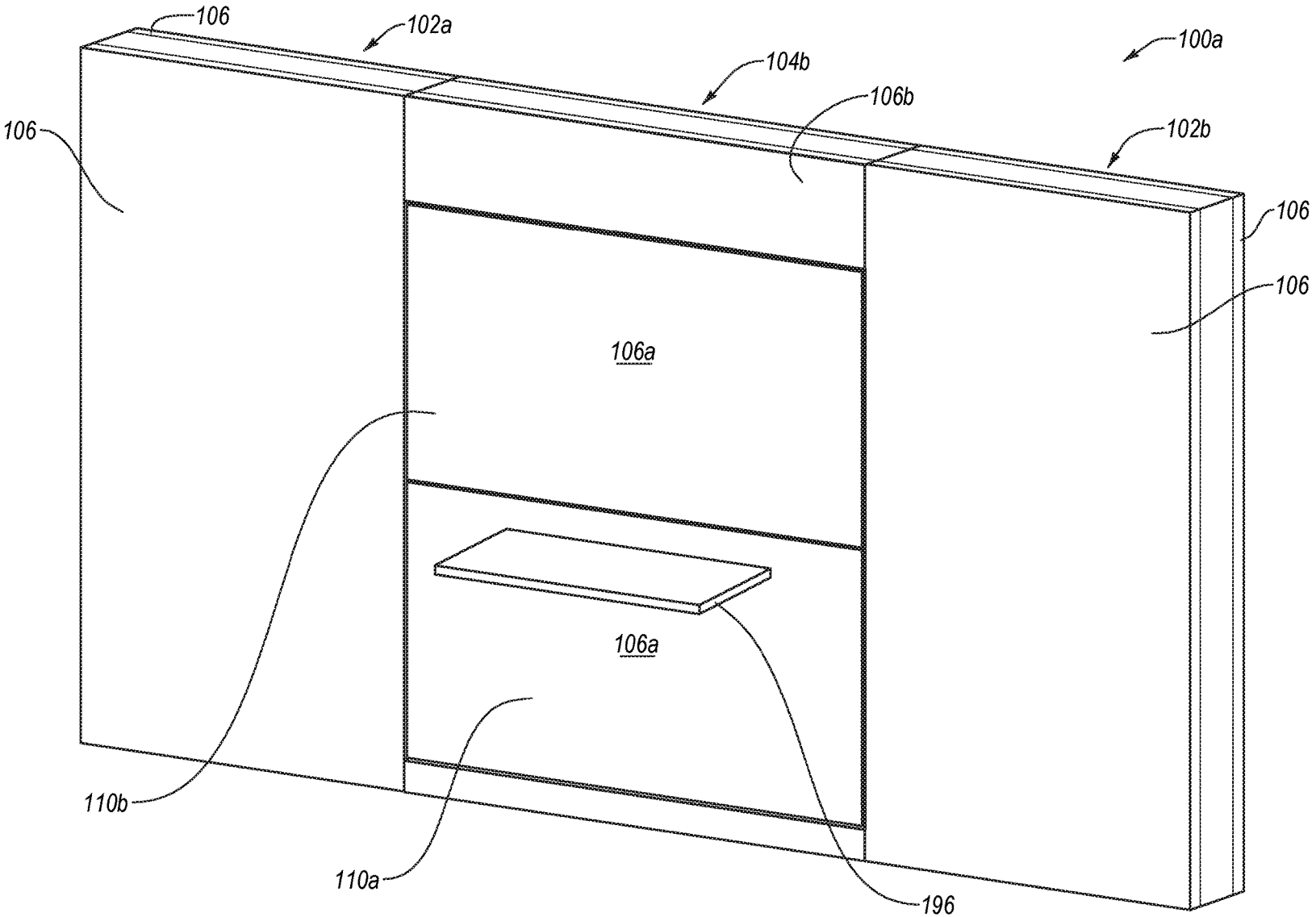
FIG. 8A illustrates a modular wall including recessed, extendable bunk beds in a closed configuration according to one or more implementations of the present invention.
Figure 8B:
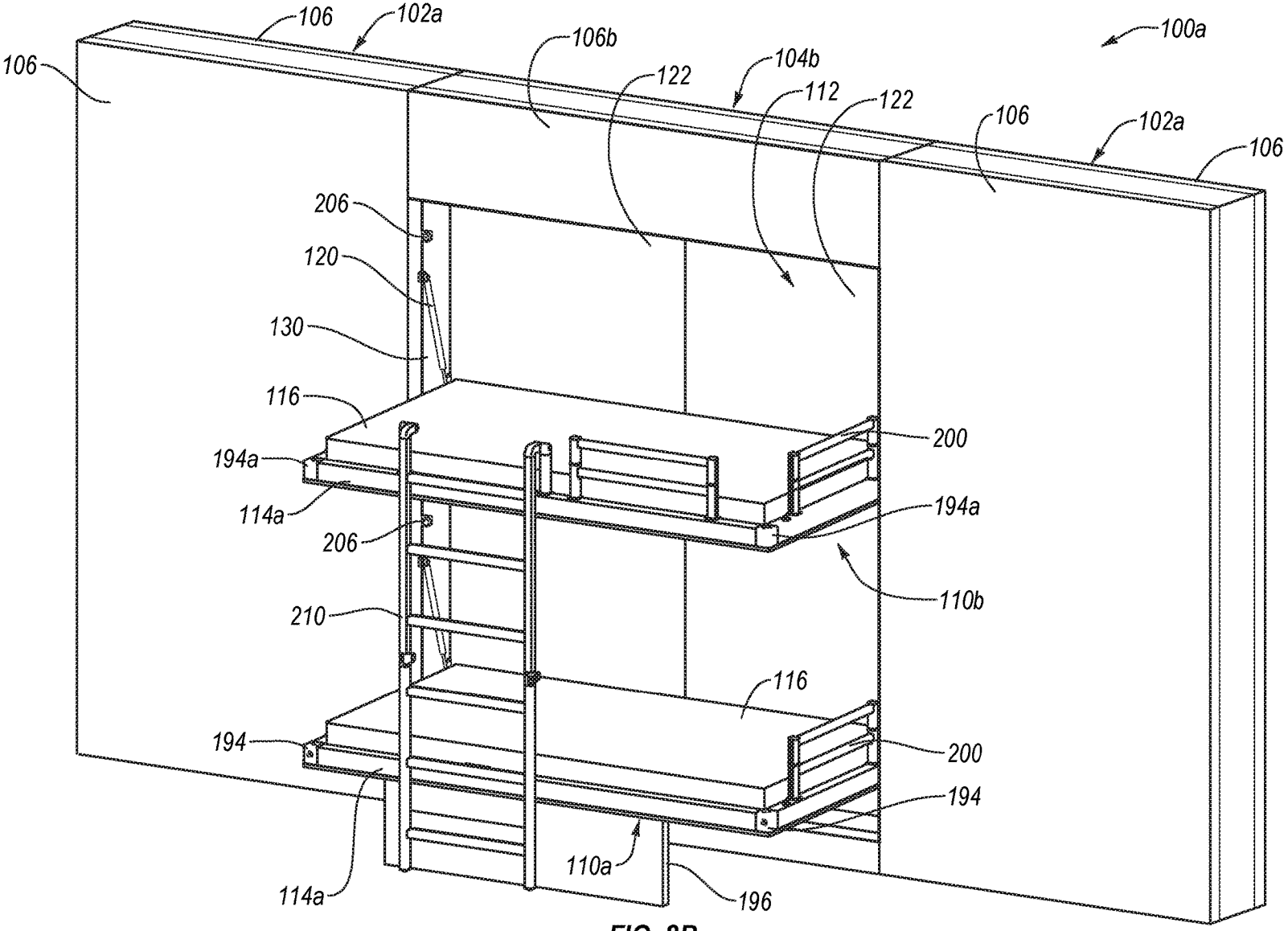
FIG. 8B illustrates the modular wall of FIG. 8A with the recessed, extendable bunk beds in an open configuration according to one or more implementations of the present invention.

For example, FIGS. 8A and 8B illustrate a modular wall 100*a* having a wall module 104*b* with multiple beds incorporated therein. In particular, FIGS. 8A and 8B illustrate a modular wall 100*a* including a plurality of wall modules 102*a*, 102*b*, 104*b*. Each of wall modules 102*a*, 102*b*, 104*b* removably connects to any of the other wall modules 102*a*, 102*b*, 104*b*. Accordingly, a designer can reconfigure modular wall 100*a* by interchanging or replacing any wall module 102*a*, 102*b*, 104*b*.

Each wall module 102*a*, 102*b*, 104*b* comprises an interior frame and one or more exterior tiles 106 connected to one or both sides of the wall module. Each wall module 102*a*, 102*b*, 104*b* includes exterior tiles 106 on each side of the wall module 102*a*, 102*b*, 104*a*. In any event, as shown by FIG. 8A and FIG. 8B, wall module 104*b* can include one or more recessed, extendable pieces of furniture, in this case recessed, extendable bunk beds 110*a*, 110*b*. As shown by FIG. 8A, when in the closed or storage position, the recessed, extendable bunk beds 110*a*, 110*b* can seamlessly fit within the modular wall 100*a*. In particular, the external tile(s) 106*a* attached to the underside of the recessed, extendable bunk beds 110*a*, 110*b* can help ensure that the wall module with recessed, extendable furniture 104*b* appears similar to the wall modules 102*a*, 102*b* without recessed, extendable furniture.

Referring now specifically to FIG. 8B, the recessed, extendable bunk beds 110*a*, 110*b* are shown in the deployed or extended position. As shown, the recessed, extendable bunk beds 110*a*, 110*b* can extend out from a pocket 112 within the wall module 104*b*. The pocket 112 thus can allow the exterior tiles 106*a* on the underside of the recessed, extendable bunk beds 110*a*, 110*b* to align flush with the exterior tiles 106 of adjacent wall modules 102*a*, 102*b*, as shown by FIG. 8A. Pocket 112 can form a continuous cavity (i.e., each of bunk beds 110*a* and 110*b* are contained within a single cavity) or may comprise separate cavities for each bunk bed 110*a*, 110*b*.

Each of the recessed, extendable bunk beds 110*a*, 110*b* can include a retaining mechanism to help hold the recessed, extendable bunk beds 110*a*, 110*b* in the recessed or storage position. For example, FIG. 8B illustrates that a magnet 206 can extend from the vertical frame bracket 130. When in the recessed or storage position (FIG. 8A) the magnets 206 can attract to the corners 194, 194*a* of the bed frames 114*a*, thereby holding the recessed, extendable bunk beds 110*a*, 110*b* in the storage position. In alternative implementations, the retaining mechanism can comprise a mechanical mechanism such as a button or snap-fit fastener.

The recessed, extendable bunk beds 110*a*, 110*b* can each include a bed frame 114*a*, a mattress 116, a pivot connection 153 (not shown in FIGS. 8A and 8B), and one more lifting and lowering mechanisms 120 similar to those described above in relation to FIGS. 1-7. Thus, each of the bed frames 114*a* can couple directly to the interior frame (i.e., vertical frame bracket 130) of wall module 104*b*. Similarly, lifting and lowering mechanisms 120 can also couple to and extend between the interior frame of the wall module 104*b* and the bed frame 114*a*.

Furthermore, the recessed, extendable bunk beds 110*a*, 110*b* can include one or more supports. For example, FIGS. 8A and 8B illustrate that the recessed, extendable bunk bed 110*a* can include a shelf 196. The shelf 196 can have a size and configuration so that when recessed, extendable bunk bed 110*a* is in the extended position (FIG. 8B), the shelf 196 extends vertically and rests on the floor to support the recessed, extendable bunk bed 110*a*. When the recessed, extendable bunk bed 110*a* is in the recessed or storage position (FIG. 8A), the shelf 196 can extend horizontally. Furthermore, the shelf 196 can aid a user in pulling the recessed, extendable bunk bed 110*a* from the recessed or storage position to the extended position.

Along similar lines, recessed, extendable bunk bed 110*b* can include similar supports to the legs 118 (described above in relation to FIGS. 6 and 7) that pivot down from corners 194*a* to corners 194 of recessed, extendable bunk bed 110*a*. In other words, the additional supports for recessed, extendable bunk bed 110 can extend to recessed, extendable bunk bed 110*a*. These additional supports may interconnect with the supports or legs of recessed, extendable bunk bed 110*a*, or may connect in some other way to recessed, extendable bunk bed 110*a*.

When recessed, extendable bunk beds 110*a*, 110*b* are folded down out of wall module 104*b*, the recessed cavity or pocket 112 is exposed. The recessed pocket 112 can include one or more tiles 122 on the back surface or one or more sides of the recessed pocket 112. The tiles 122 can serve both aesthetic and functional purposes. These tiles 122 can couple to the interior frame of the corresponding wall module 104*b* and can allow for replacement or repositioning, similar to external tiles 106. As desired, a user can exchange each tile 122 in recessed pocket 112 for another tile to change the aesthetic of the recessed pocket 112. The interchangeability of the tiles 122 can thus enable the customization of the recessed pocket 112.

FIG. 8B also shows that recessed, extendable bunk beds 110*a*, 110*b* can each include a head board 200. Similarly, although not shown, recessed, extendable bunk bed 110 can include a head board. Head boards 200 can attached directly to the bed frames 114 so that the head boards 200 can swing out as the recessed, extendable bunk beds 110*a*, 110*b* are deployed. Alternatively, head boards 200 can attach to the interior frame (e.g., vertical frame bracket 130) so that the head boards can swing out into the open position (as shown) independent of the recessed, extendable bunk beds 110*a*, 110*b*. In such implementations, headboards 200 can be swung back into pocket 112 against tiles 122 to allow recessed, extendable bunk beds 110*a*, 110*b* to fold back into cavity or pocket 112. One will appreciate that a user can place a soft cushion or other padding over the frames of the head boards 200.

In addition to legs 118, the recessed, extendable bunk beds 110*a*, 110*b* can further include a ladder 210 as shown by FIG. 8B. The ladder 210 can provide support to the upper recessed, extendable bunk bed 110*b*, while at the same time allowing a user to climb onto the upper recessed, extendable bunk bed 110*b*. In particular, once the relevant bunk bed 110*b* is lowered into a generally horizontal configuration, the ladder 210 can support the recessed, extendable bunk bed 110*b* from the floor.

Figure 9:
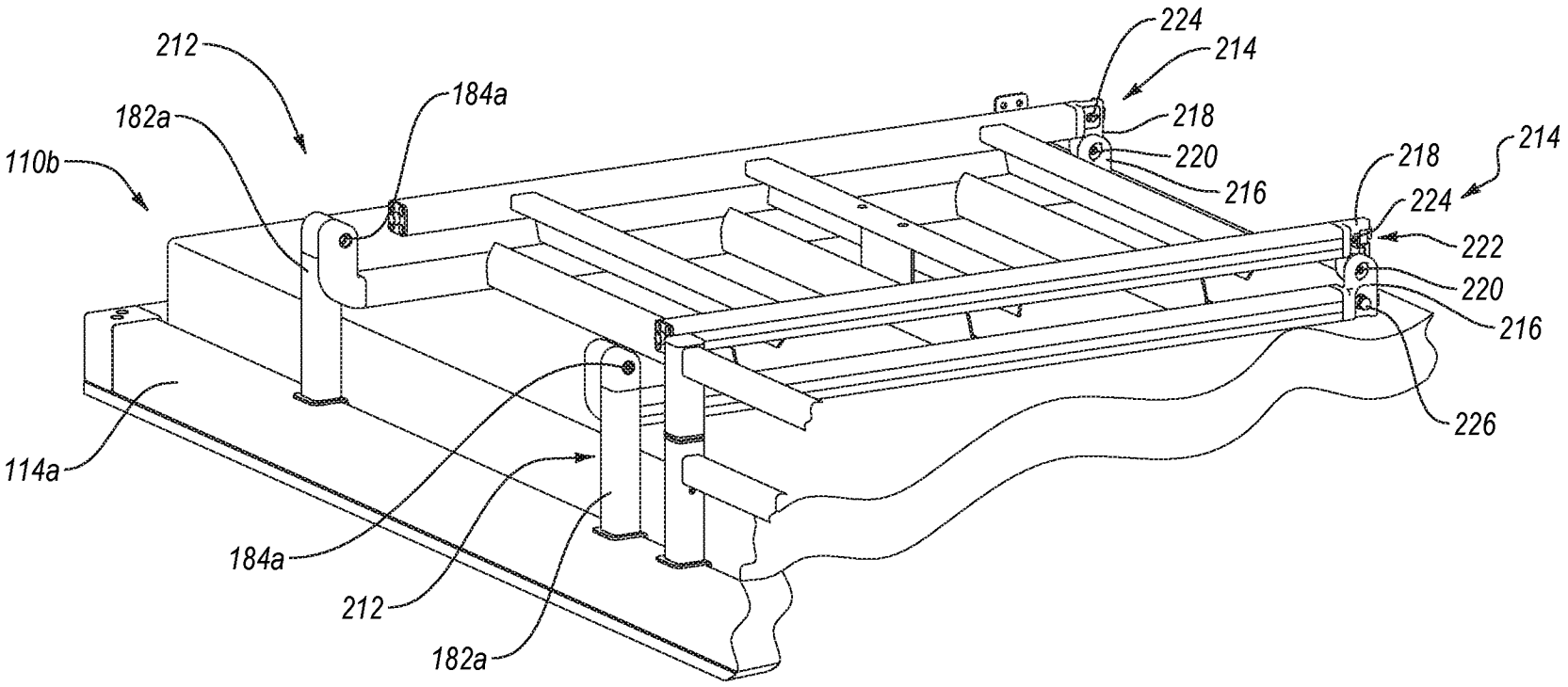
FIG. 9 illustrates the upper bunk of the modular wall with the recessed, extendable bunk beds of FIG. 8A with the ladder in a storage position.

One will appreciate that ladder 210 can move between a deployed position (FIG. 8A) and a storage position (FIG. 9). When in the deployed position the ladder 210 can support the recessed, extendable bed bunk 110*b*, and prevent it from moving below a generally horizontal position. Furthermore, the ability to move to a storage position can allow the ladder 210 to reside with the recessed pocket 112 when the recessed, extendable bunk bed 110*b* is in the storage position (FIG. 8A).

FIG. 8B illustrates that the ladder 210 extends from the upper recessed, extendable bed bunk 110*b* to the floor. One will appreciate that the present invention is not so limited. In alternative implementations, the ladder 210 can extend to and be supported by the bed frame 114*a* of the lower recessed, extendable bunk bed 110*a*. For example, the feet of the ladder 210 can couple to the bed frame 114*a* of the lower recessed, extendable bunk bed 110*a* or a rail or other catch attached to the bed frame 114*a*. Thus, the load of the upper recessed, extendable bed bunk 110*b* can transfer from the ladder 210, to the bed frame 114*a* of the lower recessed, extendable bunk bed 110*a*, and through a support mechanism (e.g., pivoting legs 118 or shelf 196) to the floor.

FIGS. 8B and 9 illustrate that a pivot mechanism 212 can couple ladder 210 to the bed frame 114*a*. In particular, pivot posts 182*a* can extend from the bed frame 114*a*. Pivot pins 184*a* can couple the ladder 210 to the pivot posts 182*a* and allow the ladder 210 to rotate between the deployed position (FIG. 8B) and the storage position (FIG. 9).

The ladder 210 can also include pivot joints 214 that allow the ladder to fold in half. In particular, as shown by FIG. 9, the pivot joints 214 can each include a first member 216 coupled to a second member 218 by a pivot pin 220. Pivot pins 220 can couple the upper and lower portions of the ladder 210 together and allow the ladder 210 to fold in half.

In one or more implementations, the pivot joints 214 can further include a locking mechanism for securing the ladder 210 in the deployed position (FIG. 8B). For example, FIG. 9 illustrates that the second member 218 can include a tapered leading end 188 and a locking hole 224. The second member 218 can interface with a locking pin 226 moveably positioned in a first member 216 of the pivot joint 214.

In particular, the locking pin 226 can move between a locked position in which the locking pin 226 is fully inserted into the first member 216, and a release position in which the locking pin 226 is pulled partially out of the first member 216. A spring or other mechanism can bias the locking pin 226 toward the locked position. As the ladder 210 is rotated toward the deployed position (FIG. 8B), the tapered end 188 can enter into the first member 216 and push the locking pin 226 outward until the locking hole 224 aligns with the locking pin 226. When the locking hole 224 aligns with the locking pin 226, the locking pin 226 can automatically enter into the locking hole 224, thereby locking the ladder 210 in the deployed position (FIG. 8B).

To unlock the ladder 210, a user can pull the locking pin 226 at least partially outward of the first member 216 so as to clear the locking hole 224. The user can then freely pivot one end of the ladder 210 about the pivot pins 220 into the storage position (FIG. 9). As shown by FIG. 9, when in the storage position, the ladder 210 can rest on the recessed, extendable bed bunk 110*b* in a folded-in-half configuration to reduce the length thereof.

FIGS. 1-9 and the corresponding text, therefore, describe and/or depict wall modules 104*a*, 104*b* including recessed, extendable beds 110, 110*a*, 110*b*. One will appreciate in light of the disclosure herein that the present invention is not so limited. In particular, the features and components described above can also provide for other types of recessed, extendable furniture in a wall module. For example, wall modules can include recessed, extendable chairs, desks, tables, shelves, work surfaces, drawers, or other furniture.

Figure 10A:
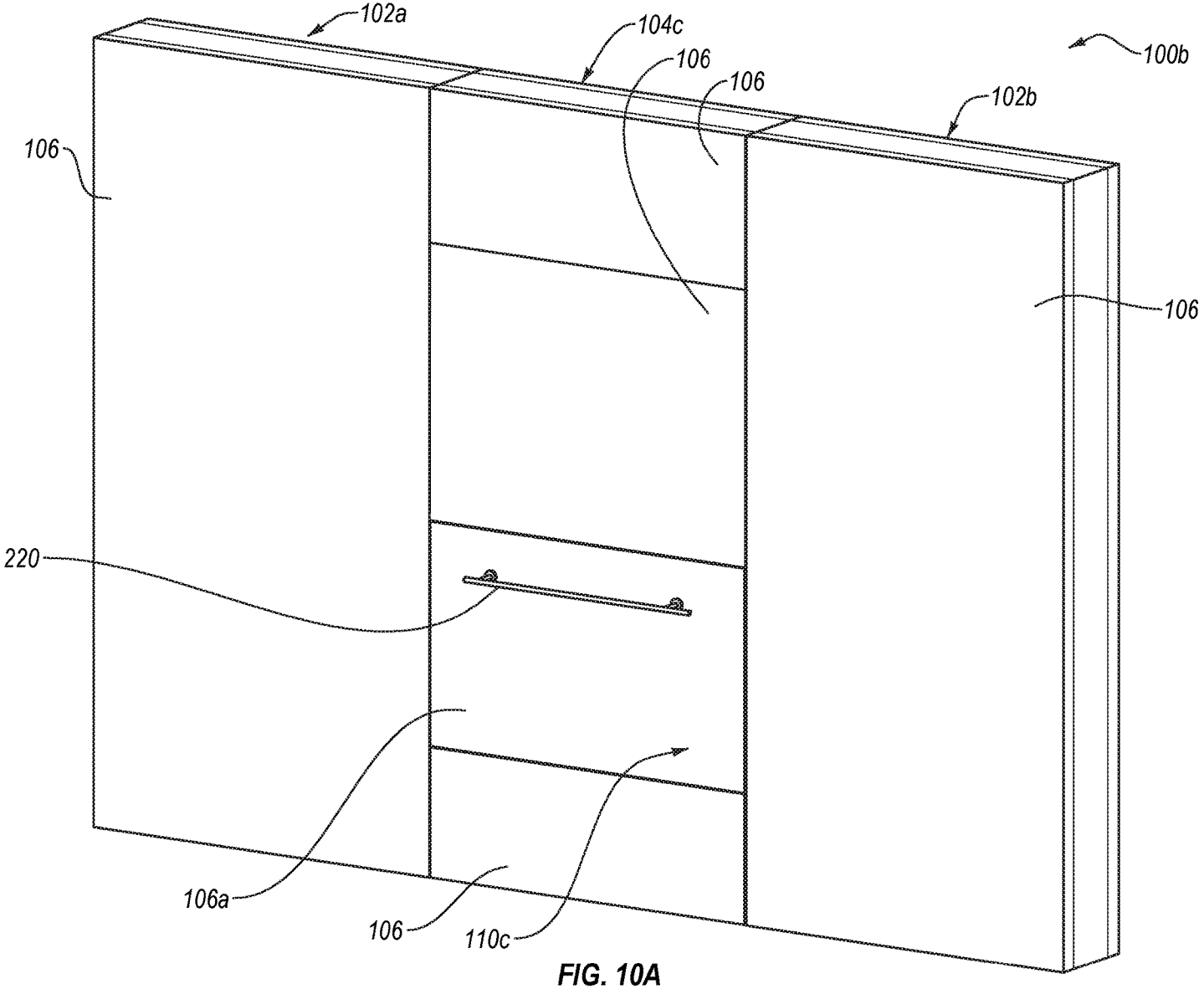
FIG. 10A illustrates a modular wall including a wall module having a recessed, extendable desk in a closed configuration according to one or more implementations of the present invention.
Figure 10B:
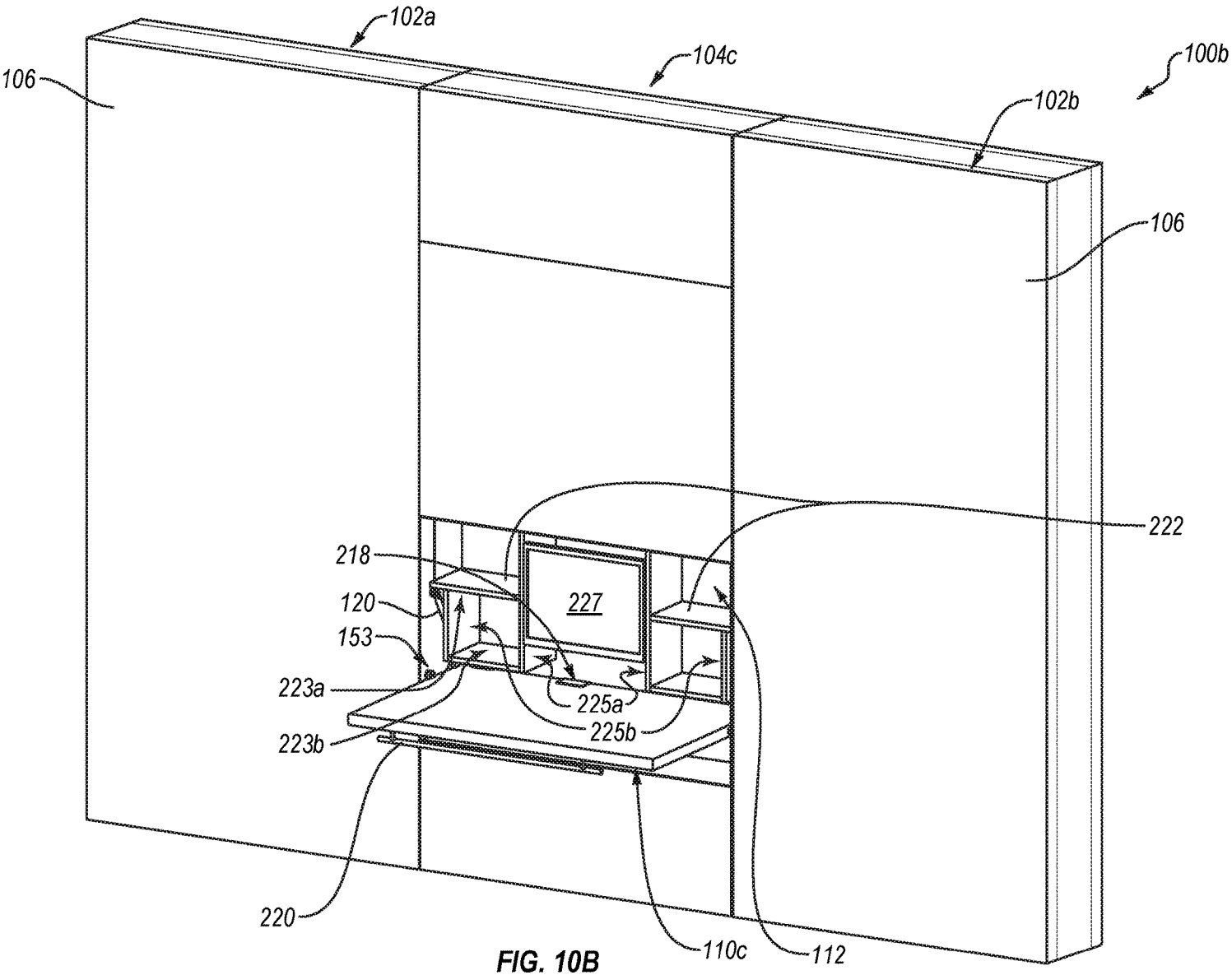
FIG. 10B illustrates the modular wall of FIG. 10A with the wall module having a recessed, extendable desk in an open configuration according to one or more implementations of the present invention.

For example, FIGS. 10A and 10B illustrate a modular wall 100*b* having a wall module 104*c* with a recessed, extendable desk incorporated therein. In particular, FIGS. 10A and 10B illustrate a modular wall 100*a* consisting of a plurality of wall modules 102*a*, 102*b*, 104*c*. Each of wall modules 102*a*, 102*b*, 104*c* removably connect to any of the other wall modules 102*a*, 102*b*, 104*c*. Accordingly, a designer can reconfigure modular wall 100*b* by interchanging or replacing any wall module 102*a*, 102*b*, 104*c*.

Each wall module 102*a*, 102*b*, 104*c* comprises an interior frame and one or more exterior tiles 106 connected to one or both sides of the wall module. As shown by FIG. 10A, when in the closed or storage position, the recessed, extendable desk 110*c* can seamlessly fit within the modular wall 100*b*. In particular, the external tile(s) 106*a* attached to the underside of the recessed, extendable desk 110*c* can help ensure that the wall module with recessed, extendable furniture 104*c* appears similar to the wall modules 102*a*, 102*b* without recessed, extendable furniture.

Referring now specifically to FIG. 10B, the recessed, extendable desk 110*c* is in the deployed or extended position. As shown, the recessed, extendable desk 110*c* can extend out from a pocket 112 within the wall module 104*c*. In this case the pocket 112 includes shelves 222 and a monitor 227 stored therein. The pocket 112 can allow the exterior tiles 106*a* on the underside of the recessed, extendable desk 110*c* to align flush with the exterior tiles 106 of adjacent wall modules 102*a*, 102*b* as shown by FIG. 10A.

Once will appreciate that a pocket 112 of increased depth can allow for shelves 222 within the pocket 112. Thus, while not shown in the recessed, extendable bed implementations, the pockets 112 in the recessed, extendable beds 110, 110*a*, 110*b* can include shelves 222 if the depth thereof is increased.

The recessed, extendable desk 110*c* can each include a pivot connection 153 and one more lifting and lowering mechanisms 120 similar to those described above in relation to FIGS. 1-7. Thus, the recessed, extendable desk 110*c* can couple directly to the interior frame (i.e., vertical frame bracket 130) of wall module 104*c*. Similarly, lifting and lowering mechanisms 120 can also couple to and extend between the interior frame of the wall module 104*c* and the recessed, extendable desk 110*c*.

As shown by FIG. 10B, recessed, extendable desk 110*c* can lower from wall module 104*c* until positioned in a generally horizontal configuration. A stop bracket 218 can prevent recessed, extendable desk 110*c* from Swinging down beyond this generally horizontal position. The stop bracket 218 can comprise a surface that extends outwardly from the back of the pocket 112, and against which an interior Surface of the recessed, extendable desk 110*c* can abut to limit the rotation of the recessed, extendable desk 110*c*. FIG. 10B also shows a plurality of inner shelves 222 mounted within the pocket 112, wherein the inner shelf comprises a plurality of vertical walls (225*a*, 225*b*) and horizontal walls (223*a*, 223*b*). In addition, FIG. 10B further shows that a front edge of the shelves 222 extends toward a facing surface defined by the one or more tiles 106 of the wall module 100*b*. FIG. 10B further shows that the monitor 227 is mounted snugly between opposing side walls 225*a* of the shelves 222. Still further, FIG. 10B shows that the monitor 227 extends to the outer, forward facing edge of the shelves. Thus, the monitor can be viewed through the opening in the front surface, mounted in a flush configuration with the shelves 222 inside the pocket 112, rather than merely resting on a lower support surface.

FIGS. 10A and 10B further illustrate that the recessed, extendable desk 110*c* can include a rod or handle 220. Handle 220 can allow a user to quickly and easily pull the recessed, extendable desk 110*c* from the recessed position to the deployed position. Similarly, although not shown, the recessed, extendable beds 110, 110*a*, 110*b* can optionally include a handle 220.

Although FIGS. 1-10B illustrate modular walls having wall modules that are each of the same depth, a modular wall according to one or more implementations of the present invention can comprise wall modules of different depths. For example, the modular wall can include one or more wall modules that are deeper than one or more other wall modules. At least one of the deeper wall modules can include recessed, extendable furniture. In such implementations, the recessed, extendable furniture can be provided on either side of the deeper wall modules. For example, referring to FIG. 1A, a wall bed can be provided on either the front or rear side of wall module 104*a*.

Because each wall module of a modular wall system according to the present invention provides for independent movement and connection to another wall module, a user can reposition or combine wall modules 102*a*, 102*b*, 104*a*, 104*b*, 104*c* as desired. For example, a user can combine wall modules 102*a*, 102*b*, 104*a*, 104*b*, 104*c* into a single modular wall or interchange wall modules 102*a*, 102*b*, 104*a*, 104*b*, 104*c* as desired. Further, if it were desired to remove wall modules 104*a*, 104*b*, 104*c* from the modular wall, a wall module 102*a*, 102*b* without recessed, extendable furniture could be exchanged with wall modules 104*a*, 104*b*, 104*c*.

In any event, one will appreciate that implementations of the present invention can provide a wide variety of modular wall system that provide a wide variety of benefits. For example, implementations of the present invention can provide a wall module having recessed, extendable furniture that is incorporated into the wall. This is in contrast to free standing murphy beds, and other modular furniture that sits in front of a wall. Furthermore, implementations of the present invention can provide a wall module having recessed, extendable furniture that is easily reconfigurable. This is in contrast to built-in murphy beds and other built-in furniture that is permanently fixed in a wall.

The present invention may be embodied in other specific forms without departing from its spirit or essential characteristics. The described implementations are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A wall module, comprising:

a frame configured to removably couple the wall module to one or more additional wall modules to form a reconfigurable modular wall, the frame comprising one or more vertical frame brackets;

one or more tiles removably connected to the frame to at least partially define a front surface of the wall module, each of the one or more tiles being removable while the wall module remains removably coupled to the one or more additional wall modules;

an opening in the front surface of the wall module, the opening at least partially defining a pocket in the wall module that extends from the front surface into the wall module, wherein at least one of the one or more vertical frame brackets at least partially defines a generally planar wall body on one or more sides of the pocket;

one or more inner wall panels coupled to at least one of the one or more vertical frame brackets, such that each of the one or more inner wall panels extends into the pocket;

a plurality of inner shelves mounted within the pocket, the plurality of inner shelves comprising at least a plurality of vertical walls that define opposing side walls of the plurality of inner shelves, wherein a front edge of the plurality of inner shelves is oriented adjacent one of the one or more tiles of the wall module; and a monitor disposed within and flush with opposing side walls of the plurality of inner shelves of the pocket such that the monitor is suspended within the pocket and can be viewed through the opening in the front surface.

2. The wall module as recited in claim 1, wherein the monitor is an electronic display.

3. The wall module as recited in claim 1, further comprising a cover that covers the opening in the front surface.

4. The wall module as recited in claim 3, wherein the cover is configured to selectively cover the opening in the front surface.

5. The wall module as recited in claim 4, wherein the cover is configured to conceal the monitor in the pocket when the cover is in a closed position.

6. The wall module as recited in claim 4, wherein the cover comprises a selectively extendable piece of furniture.

7. The wall module as recited in claim 6, wherein the selectively extendable piece of furniture comprises a shelf, a desk, a chair, a bed, or a table.

8. The wall module as recited in claim 1, wherein the pocket further comprises one or more pocket tiles removably coupled to the frame, and wherein the one or more pocket tiles are removable from the frame while the wall module remains removably coupled to the one or more additional wall modules.

9. The wall module as recited in claim 8, wherein the one or more vertical frame brackets further comprises attachment plates, the one or more inner wall panels being coupled to the frame by means of the attachment plates, and wherein the attachment plates are offset from the wall body such that the inner wall panels are held flush with the wall body.

10. The wall module as recited in claim 1 further comprising:

one or more connectors;

wherein the frame further comprises engagement protrusions, the one or more connectors configured to removably couple the engagement protrusions of the wall module to engagement protrusions of the one or more additional wall modules.

11. The wall module as recited in claim 10, wherein the engagement protrusions comprise arrow-shaped barbs.

12. The wall module as recited in claim 10, wherein each of the one or more connectors abuts at least one engagement protrusion on at least two sides.

13. The wall module as recited in claim 4, wherein the cover is configured to selectively cover the opening in the front surface by rotating between an open position and a closed position.

14. The wall module as recited in claim 13, wherein the cover is attached to the one or more vertical frame brackets by a pivot connection and by one or more lifting and lowering mechanisms extending from the one or more vertical frame brackets.

15. The wall module as recited in claim 13, further comprising a stop bracket extending from an interior portion of the pocket, the stop bracket being arranged to abut the cover when the cover is rotated into the open position.

16. The wall module as recited in claim 15, wherein the stop bracket is arranged to abut the cover when the cover is in a generally horizontal configuration relative to the one or more vertical frame brackets.

17. The wall module as recited in claim 4, wherein at least a portion of the cover is configured to at least partially reside within the pocket when the cover is in a closed position.

18. The wall module as recited in claim 17, wherein an exterior surface of the cover is aligned with the one or more tiles removably connected to the frame when the cover is in the closed position, such that the exterior surface of the cover is flush with the front surface of the wall module when the cover is in the closed position.

19. The wall module as recited in claim 18, wherein the cover comprises a handle extending from the exterior surface of the cover.

20. The wall module as recited in claim 19, wherein the handle comprises a rod extending horizontally with respect to the vertical frame brackets.

* * * * *